US010478943B2

(12) United States Patent
Nakamura et al.

(10) Patent No.: US 10,478,943 B2
(45) Date of Patent: Nov. 19, 2019

(54) GRINDER, COVER AND COVER SET

(71) Applicant: MAKITA CORPORATION, Anjo-Shi (JP)

(72) Inventors: Shin Nakamura, Anjo (JP); Takafumi Kotsuji, Anjo (JP); Ken Goto, Anjo (JP); Akira Mizutani, Anjo (JP); Junya Ishikawa, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 320 days.

(21) Appl. No.: 15/258,045

(22) Filed: Sep. 7, 2016

(65) Prior Publication Data

US 2017/0072534 A1 Mar. 16, 2017

(30) Foreign Application Priority Data

Sep. 10, 2015 (JP) ..... 2015-178871

(51) Int. Cl.
*B24B 55/05* (2006.01)
*B24B 23/02* (2006.01)
*B25F 5/02* (2006.01)

(52) U.S. Cl.
CPC ..... *B24B 55/052* (2013.01); *B24B 23/02* (2013.01); *B24B 23/028* (2013.01); *B25F 5/02* (2013.01); *B25F 5/026* (2013.01)

(58) Field of Classification Search
CPC ..... B27G 19/02; B27G 19/04; B24B 23/02; B24B 23/028; B24B 55/05; B24B 55/052; B24B 55/055
USPC ..... 451/358, 359
See application file for complete search history.

(56) References Cited

U.S. PATENT DOCUMENTS 3,673,744 A * 7/1972 Oimoen ..... B24B 55/102 451/353
3,793,784 A 2/1974 Jetzt
4,060,940 A * 12/1977 DeWitt ..... B24B 55/05 451/358

(Continued)

FOREIGN PATENT DOCUMENTS

DE 29717099 U1 12/1997
DE 10107290 A1 9/2002

(Continued)

OTHER PUBLICATIONS

Office Action from the United States Patent Office dated Apr. 17, 2018 in related U.S. Appl. No. 15/258,010, including examined claims 1-19.

(Continued)

*Primary Examiner* — Monica S Carter
*Assistant Examiner* — Marcel T Dion
(74) *Attorney, Agent, or Firm* — J-Tek Law PLLC; Jeffrey D. Tekanic; Scott T. Wakeman

(57) ABSTRACT

A grinder (100) includes a motor (12), a housing (4, 6, 30), a spindle (24), a first cover (120), and a second cover (170). The spindle protrudes downward from the housing, is driven by the motor, and thereby rotates. The first cover is provided in the circumferential direction of the spindle, is fixed to the housing, and at least partially covers a tool accessory (40), which is mounted on the spindle, from above. The second cover is detachably mounted on the housing (6) independently of the first cover.

12 Claims, 35 Drawing Sheets

(56) References Cited

U.S. PATENT DOCUMENTS

| | | | | | |
|---|---|---|---|---|---|
| 4,343,115 | A * | 8/1982 | Stabler | B23Q 11/08 | 144/251.1 |
| 4,622,782 | A | 11/1986 | Roestenberg | | |
| 5,713,785 | A * | 2/1998 | Nishio | B24B 55/052 | 125/9 |
| 5,766,062 | A | 6/1998 | Edling | | |
| 6,155,916 | A * | 12/2000 | Rudolf | B25F 5/026 | 451/344 |
| 6,471,574 | B1 * | 10/2002 | Rupprecht | B24B 23/02 | 451/45 |
| 6,699,114 | B1 | 3/2004 | Booeshaghi et al. | | |
| 8,523,637 | B2 * | 9/2013 | Loveless | B24B 55/052 | 451/356 |
| 2006/0068690 | A1 | 3/2006 | Koschel et al. | | |
| 2009/0029635 | A1 | 1/2009 | Boeck et al. | | |
| 2009/0186559 | A1 * | 7/2009 | Loveless | B24B 55/10 | 451/28 |
| 2009/0197515 | A1 | 8/2009 | Wang | | |
| 2009/0229436 | A1 | 9/2009 | Crain et al. | | |
| 2010/0210195 | A1 | 8/2010 | Numata et al. | | |
| 2010/0261417 | A1 | 10/2010 | O'Shannessy | | |
| 2010/0304648 | A1 | 12/2010 | Boeck et al. | | |
| 2011/0092141 | A1 | 4/2011 | McCutchen et al. | | |
| 2011/0318999 | A1 | 12/2011 | Boeck et al. | | |
| 2012/0190280 | A1 | 7/2012 | Esenwein | | |
| 2013/0000935 | A1 * | 1/2013 | Kelleher | B24B 23/028 | 173/46 |
| 2013/0157550 | A1 * | 6/2013 | Ikuta | B24B 23/028 | 451/451 |
| 2014/0329447 | A1 * | 11/2014 | Copeland | B24B 23/028 | 451/451 |
| 2014/0342645 | A1 | 11/2014 | Tagscherer | | |
| 2016/0297051 | A1 * | 10/2016 | Aiken | B24B 55/052 | |
| 2017/0072532 | A1 | 3/2017 | Kawakami et al. | | |
| 2017/0072533 | A1 | 3/2017 | Yoshizaki et al. | | |
| 2017/0072535 | A1 | 3/2017 | Iwakami et al. | | |

FOREIGN PATENT DOCUMENTS

| | | | | | |
|---|---|---|---|---|---|
| DE | 102007041840 | A1 | | 5/2008 | |
| DE | 102007046311 | A1 | | 4/2009 | |
| DE | 102008022294 | A1 | | 10/2009 | |
| DE | 102009028404 | A1 | | 2/2011 | |
| DE | 102012207571 | A1 | | 10/2013 | |
| EP | 0267993 | A1 | | 5/1988 | |
| EP | 0812657 | A1 | | 12/1997 | |
| EP | 1642680 | A1 | | 4/2006 | |
| EP | 1952944 | A1 | | 8/2008 | |
| EP | 2205397 | B1 | | 3/2012 | |
| GB | 940226 | A | | 10/1963 | |
| GB | 2329440 | A | * | 3/1999 | B23Q 11/06 |
| JP | S5813952 | U | | 1/1983 | |
| JP | H02122755 | U | | 10/1990 | |
| JP | 2009000795 | A | | 1/2009 | |
| JP | 2010029986 | A | | 2/2010 | |
| JP | 2013078823 | A | | 5/2013 | |
| JP | 2013193177 | A | | 9/2013 | |
| JP | 2013226617 | A | | 11/2013 | |
| WO | 2013161444 | A1 | | 10/2013 | |

OTHER PUBLICATIONS

Office Action from the United States Patent Office dated Apr. 18, 2018 in related U.S. Appl. No. 15/257,987, including examined claims 1-19.

U.S. Appl. No. 15/257,987, filed Sep. 7, 2016.

U.S. Appl. No. 15/258,010, filed Sep. 7, 2016.

U.S. Appl. No. 15/258,098, filed Sep. 7, 2016.

Extended European Search Report from the European Patent Office dated Feb. 20, 2017 in related EP application No. 16 187 679.2, including European Search Opinion, European Search Report, and examined claims 1-15.

Extended European Search Report from the European Patent Office dated Feb. 20, 2017 in related EP application No. 16 187 688.3, including European Search Opinion, European Search Report, and examined claims 1-12.

Extended European Search Report from the European Patent Office dated Feb. 21, 2017 in related EP application No. 16187692.5 including European Search Opinion, European Search Report, and examined claims 1-14.

Extended European Search Report from the European Patent Office dated Jan. 31, 2017 in related EP application No. 16 187 675.0, including European Search Opinion, European Search Report, and examined claims 1-9.

Office Action from the Japanese Patent Office dispatched Mar. 26, 2019 in counterpart Japanese application No. 2015-178871, and translation thereof.

* cited by examiner

GRINDER, COVER AND COVER SET

CROSS-REFERENCE TO RELATED APPLICATION

This application claims priority to Japanese patent application no. 2015-178871 filed on Sep. 10, 2015, the contents of which are fully incorporated herein by reference.

TECHNICAL FIELD

The present disclosure relates to a grinder.

BACKGROUND

A grinder is known that is capable of performing processing, such as grinding, polishing, cutting, or the like, on a workpiece. The grinder comprises a spindle that is rotationally driven by a drive device. Various tool accessories are detachably mountable on the spindle. A protective cover that covers the tool accessory from above is normally mounted on the grinder (e.g., refer to Japanese Laid-open Patent Publication No. 2013-78823).

SUMMARY

If the surface area over which the protective cover covers the tool accessory is increased in order to reduce the dispersion of dust, then the protective cover interferes with the workpiece, thereby reducing work efficiency and grinder processing performance.

Consequently, conventionally, a protective cover is prepared for each type of tool accessory. A specialized protective cover for each type of tool accessory makes it possible, owing to the cover's shape being made suited to the processing work, to achieve high work efficiency and high processing performance while reducing the dispersion of dust.

Nevertheless, exchanging the protective cover, in addition to exchanging the tool accessory, is very labor intensive for users, especially when the same grinder will be used to perform several different types of processing (with different tool accessories) in a short period of time. Consequently, conventionally, there have been many users who exchange only the tool accessory, without exchanging the protective cover, and then perform the processing with the grinder.

Accordingly, in one preferable aspect of the present disclosure, a grinder and a cover are provided that are highly convenient while having the ability to reduce the dispersion of dust.

A grinder according to one aspect of the present disclosure comprises a motor, a housing, a spindle, and first and second covers. The housing houses the motor. The spindle protrudes downward from the housing, is driven by the motor, and thereby rotates. The first and second covers at least partially cover the tool accessory mounted on the spindle.

According to another aspect of the present disclosure, a first cover is configured such that it is provided in the circumferential direction of the spindle, is fixed to the housing, and at least partially covers the tool accessory from above. A second cover is detachably mounted on the first cover.

In a grinder that comprises the above-mentioned first and second covers, the second cover can be mounted on or dismounted from the first cover in accordance with the type of the tool accessory and the difference in the workpiece processing method to be performed with the particular tool accessory. Accordingly, in this aspect of the present disclosure, a highly convenient grinder can be provided. The mounting of the second cover on the first cover can be performed in order to augment, using the second cover, the area covered by the first cover or to cover, using the second cover, the area not covered by the first cover.

According to another aspect of the present disclosure, the second cover can be configured such that it at least partially covers, when the second cover is mounted on the first cover, the area below the tool accessory not covered by the first cover. According to this configuration, the area of the tool accessory, within the circumference of the tool accessory, covered by the first and second covers can be adjusted by mounting and dismounting the second cover.

Cover mounting/dismounting can be performed in order to, for example, prevent interference between the tool accessory and the workpiece when performing processing work. Alternatively, the mounting/dismounting can be performed in order to prevent interference between the tool accessory and the cover when the tool accessory is being exchanged. Accordingly, in this aspect of the present disclosure, it is possible to provide a highly convenient grinder, even if different types of the tool accessory are used.

According to another aspect of the present disclosure, the second cover may be configured such that the area below the tool accessory not covered by the first cover is at least partially covered. As is well known, the portion of the tool accessory that is proximate to the workpiece during processing work differs according to the type of the tool accessory and the processing method. In one type of operation, the lower surface of the tool accessory is used; in another type of operation, the side surface or the side edge of the tool accessory is used. Accordingly, a grinder, in which the coverage below the tool accessory is modifiable by mounting/dismounting the second cover, exhibits high work efficiency for the variety (multiplicity) of operations described above.

According to another aspect of the present disclosure, the second cover may be at least partly composed of an elastic material. The second cover may be configured such that it is mounted on and removed (dismounted) from the first cover by elastically deforming. According to this configuration, the user can mount the second cover on the first cover or remove (dismount) the second cover from the first cover in a simple manner, and the second cover can be suitably fixed to (held on) the first cover by elastic deformation (elastic squeezing). In other words, according to the above-mentioned configuration, it is possible to greatly facilitate the user work of mounting/dismounting the second cover and, as needed, to suitably prompt the user to mount or dismount the second cover.

According to another aspect of the present disclosure, the grinder may be configured such that the second cover can be mounted on the first cover with (at or in) a plurality of orientations. The grinder can be configured such that an area of the tool accessory covered by the first and second covers changes in accordance with the orientation of the second cover. According to such a grinder, the user can modify (e.g., rotate) the orientation of the second cover such that work efficiency is not reduced by the coverage, while at the same time taking into consideration a reduction of the dispersion of dust.

According to another aspect of the present disclosure, the second cover can be configured such that, if the second cover is to be mounted on the first cover with (at or in) a first orientation from among the plurality of orientations, then the second cover is mounted on the first cover such that an outer surface of an upper part of the first cover and an inner surface of the second cover that faces the tool accessory approach one another and the second cover is housed on the outer-surface side of the upper part of the first cover. The second cover can be configured such that, if the second cover is to be mounted on the first cover with a second orientation from among the plurality of orientations, then the second cover is mounted on the first cover such that the inner surface of the second cover opposes the inner surface of the first cover that faces the tool accessory and a space that houses the tool accessory is formed between the inner surface of the second cover and the inner surface of the first cover, and thereby the tool accessory is at least partially covered from below.

Alternatively, the second cover may be configured such that, if the second cover is to be mounted on the first cover with (at or in) the first orientation from among the plurality of orientations, then the second cover is mounted on the first cover such that the outer surface of the second cover, on the side opposite the inner surface of the second cover that faces the tool accessory, and the inner surface of the first cover that faces the tool accessory approach one another, and thereby the second cover is housed on the inner surface side of the first cover.

According to these configurations, the area of the tool accessory that is covered from below can be modified by modifying the orientation of the second cover. Furthermore, when the second cover is not being used for the purpose of covering the area below the tool accessory, the orientation of the second cover with respect to the first cover can be changed and the second cover can remain attached to the first cover. Accordingly, it is possible to reduce the possibility that the user will lose the second cover. This is because, when the second cover is not in use for the above-noted purpose, there is no need to detach the second cover from the first cover. Therefore, according to this configuration as well, a highly convenient grinder can be provided.

According to another aspect of the present disclosure, the first and second covers may have holes that are aligned and that communicate with one another when the second cover is mounted on the first cover. In this case, the second cover may be fixed to the first cover by the function of a fixture mounted in the holes when the second cover is mounted on the first cover. The grinder can comprise a fixing part (fixture) that is configured to be mounted in or removed (dismounted) from a hole. The first and second covers can be provided with communicating holes both when the second cover is mounted on the first cover with any of the above-mentioned orientations as well as when the second cover is mounted with either of the above-mentioned first and second orientations. According to such a configuration, the second cover, while being detachable, can be suitably fixed to the first cover.

According to another aspect of the present disclosure, the first cover comprises an upper-part structure and a side-part structure, which extends downward from a side edge of the upper-part structure, at least partially covers the tool accessory from above and the side, and has an opening below. In this embodiment, the second cover can be configured such that it is detachably mounted in the opening of the first cover and at least partially covers the tool accessory from below.

According to another aspect of the present disclosure, the first cover may comprise a ridge that extends along an inner side of the opening; the second cover may be configured such that a recessed part, which engages with the ridge of the first cover, is provided in a side edge of the second cover; and the second cover is mounted on the first cover, such that the second cover engages with the ridge, is supported by the ridge, and at least partially covers the tool accessory from below at the opening.

According to another aspect of the present disclosure, the first cover may be configured such that it has an elongated recess that extends along an inner side of the opening. The second cover may be configured such that it has a side edge that engages with the elongated recess of the first cover. Furthermore, the second cover is mounted on the first cover, such that it engages with the elongated recess, is supported by the elongated recess, and at least partially covers the tool accessory from below at the opening.

According to another aspect of the present disclosure, a grinder may be provided that comprises: a motor; a housing; a spindle; a first cover that is provided in a circumferential direction of the spindle, is fixed to the housing, and at least partially covers a tool accessory, which is mounted on the spindle, from above; and a second cover that is detachably mounted on the first cover and at least partially covers an area of the tool accessory not covered by the first cover.

According to another aspect of the present disclosure, a grinder may be provided that comprises: a motor; a housing; a spindle; a first cover that is provided in a circumferential direction of the spindle, is fixed to the housing, and at least partially covers a tool accessory, which is mounted on the spindle, from above; and a second cover that is mounted on the housing, independently of the first cover. The second cover can be detachably mounted on the housing. The second cover can be configured such that it at least partially covers the area of the tool accessory not covered by the first cover.

According to another aspect of the present disclosure, the housing may comprise a grip-fixing part for detachably fixing a grip (handle) that is gripped (held) by a user; and the second cover may be detachably fixed to the housing via the grip-fixing part. According to this configuration, the grip-fixing part of the grinder can be effectively utilized, and the second cover can be easily and suitably fixed.

According to another aspect of the present disclosure, the housing can comprise an upper-part housing, which comprises a grip-fixing part for detachably fixing a grip that is gripped by a user, and a lower-part housing, which is fixed to the upper-part housing and from which the spindle protrudes downward. In this embodiment, the first cover may be fixed to the lower-part housing, and the second cover may be configured such that it is detachably fixed to the upper-part housing via the grip-fixing part and at least partially covers the area of the tool accessory not covered by the first cover.

According to another aspect of the present disclosure, the second cover may comprise: a cover main body that at least partially covers the tool accessory from below; and a holder, one end of which is detachably fixed to the housing (e.g., via the grip-fixing part), that extends from the one end downward of the tool accessory and holds the cover main body below the tool accessory. The cover main body may be configured such that it is held by the holder so as to be rotatable in the circumferential direction and such that it can modify the area over which the tool accessory is covered.

In addition, according to another aspect of the present disclosure, the first and second covers described above, which are mounted on the grinder, may be provided. According to another aspect of the present disclosure, a cover set, which at least partially covers a tool accessory mounted on a spindle that protrudes downward from a housing of the grinder, may be provided, wherein the cover set comprises first and second covers, which have at least one of the features discussed above. According to another aspect of the present disclosure, the first cover and the second cover may be provided as standalones (i.e., provided separately from the grinder).

According to another aspect of the present disclosure, an auxiliary cover may be provided for a grinder that comprises a spindle, which protrudes downward from a housing, and an attached cover is provided in a circumferential direction of the spindle, is fixed to the housing, and at least partially covers the tool accessory, which is mounted on the spindle, from above. The auxiliary cover is at least partly composed of an elastic material, is detachably mounted on the attached cover by elastically deforming, and is configured such that it at least partially covers an area of the tool accessory not covered by the attached cover.

According to another aspect of the present disclosure, a cover is provided that at least partially covers a tool accessory, the tool accessory being mounted on a spindle that protrudes downward from a housing of a grinder, the housing having a grip-fixing part The cover comprises: a cover main body that at least partially covers the tool accessory from below; and a holder, one end of which is fixed to the housing via the grip-fixing part, that extends from the one end downward of the tool accessory and holds the cover main body below the tool accessory.

DETAILED DESCRIPTION OF EMBODIMENTS

Illustrative embodiments of the present disclosure are explained below, with reference to the drawings.

Basic Configuration

First, the internal configuration of a basic grinder 1 will be explained. The grinder 1 is a so-called disc grinder to which a discoidal (disc-shaped) tool accessory (tip tool) 40 is attached. The grinder 1 performs processing on a workpiece by rotating the tool accessory 40. The tool accessory 40 includes a variety of grinding wheels, such as a cutting stone, a grinding stone, or the like, and further may comprise a wire brush. The grinder 1 is configured such that the tool accessory 40 is exchangeable.

Figure 1:
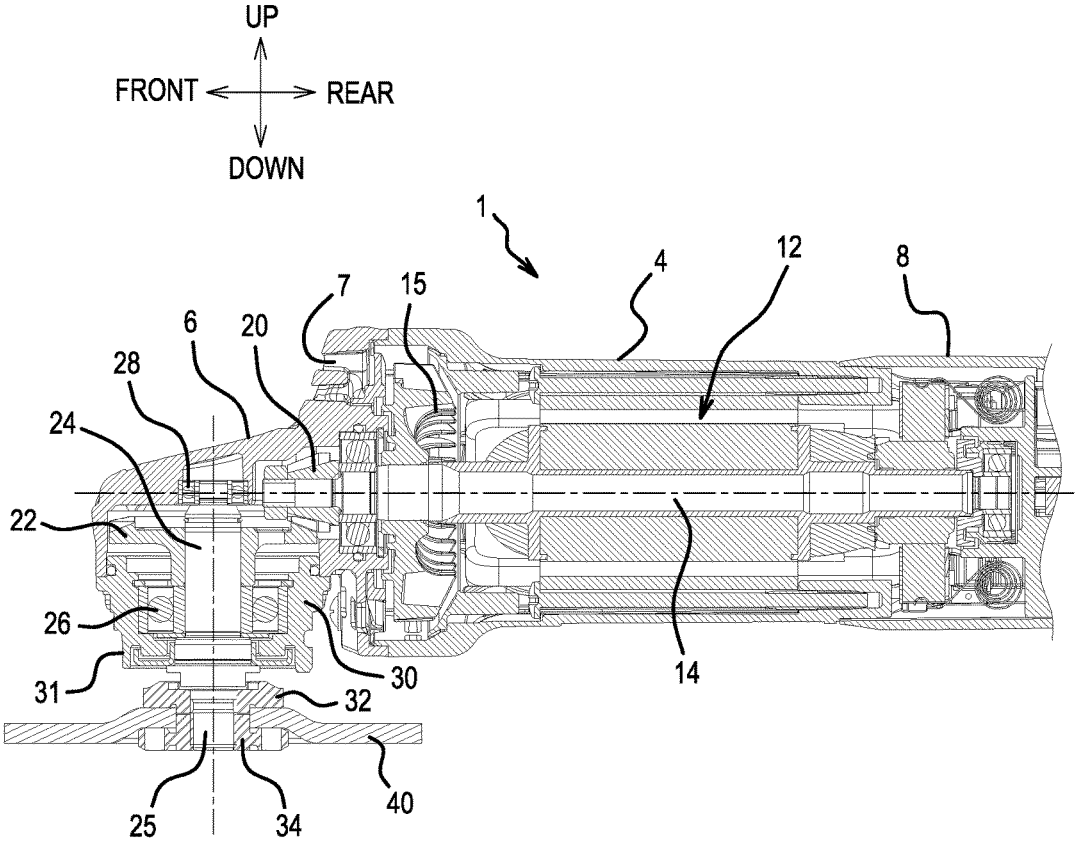
FIG. 1 is a cross-sectional view that shows the internal configuration of a grinder.

Grinders 100, 200, 300, 400, 500, 600, 700, 800 according to a first embodiment to an eighth embodiment, which are explained following the explanation of the grinder 1, are each configured such that, in each embodiment, a characteristic protective cover is attached to the grinder 1 shown in FIG. 1 or to a similar grinder.

In the plurality of these embodiments, a front-rear direction is defined along an axis line of an elongated grinder main body or along a corresponding rotary shaft 14 of a motor 12. Specifically, the side on which a spindle 24 is provided on the grinder main body is defined as the "front" and the opposite side is defined as the "rear."

In addition, an up-down direction is defined based on an axis line of the spindle 24. Specifically, the side on which the spindle 24 is housed in a first gear housing 6 and a second gear housing 30 is defined as "up," and the side on which the tool accessory 40 is mounted on the spindle 24 is defined as "down." In addition, a surface that extends in the up-down direction is defined as a "side surface" and thus utilizes a term related to direction.

The grinder 1 shown in FIG. 1 comprises a motor housing 4, the first gear housing 6, and a rear cover 8. The grinder 1 further comprises the second gear housing 30. The internal elements that constitute the grinder 1 are housed in an internal space of the grinder main body, which is principally formed by the motor housing 4, the first gear housing 6, the second gear housing 30, and the rear cover 8.

The motor housing 4 is a substantially circular-cylindrical housing and houses the motor 12. The rotary shaft 14 of the motor 12 is disposed such that it protrudes toward the first gear housing 6, which is adjacent to the motor housing 4. The rear cover 8 is provided rearward of the motor housing 4 and houses circuitry for supplying drive current to the motor 12, thereby driving the motor 12. The circuitry is supplied with external electric power via a power-supply cord 18 (refer to FIG. 3, etc.), which is not shown in FIG. 1. The drive of the grinder 1 is turned ON and OFF by a user operating a switch-operation unit 19 (not shown in FIG. 1) that is provided such that it is externally exposed.

The first gear housing 6 is provided forward of the motor housing 4 and houses a first bevel gear 20, a second bevel gear 22, the spindle 24, and bearings 26, 28. The first bevel gear 20 is fixed to a rotary shaft of the motor 12 inside the first gear housing 6. The second bevel gear 22 and the spindle 24 are rotatably provided in the second gear housing 30, which is configured as a structure separate from the first gear housing 6, via the bearing 26. The second bevel gear 22 and an upper part of the spindle 24 are housed inside the first gear housing 6 by virtue of the second gear housing 30 being fixed to the first gear housing 6.

The second gear housing 30 is fixed to the first gear housing 6 such that the spindle 24 is orthogonal to the rotary shaft 14 of the motor 12. The second gear housing 30 is, for example, screw-fastened to the first gear housing 6.

The second bevel gear 22 is fixed to the spindle 24. The second bevel gear 22 meshes with the first bevel gear 20 inside the first gear housing 6, and the rotational output of the motor 12 is thereby converted into a rotational force around the axis of the spindle 24.

One end of the spindle 24 is rotatably supported by the first gear housing 6 via the bearing 28, and the other end of the spindle 24 protrudes downward from the second gear housing 30.

An inner flange 32 for positioning and fixing the discoidal (disk-shaped) tool accessory 40 is provided on the portion of the spindle 24 that protrudes from the second gear housing 30. A screw part 25, onto which a lock nut 34 is screwed, is formed on an outer-circumferential portion of the spindle 24 that is closer to the tip than is the inner flange 32. The lock nut 34 is fixed to a lower end of the spindle 24 by screw-fastening, and the tool accessory 40 is sandwiched and fixed between the lock nut 34 and the inner flange 32.

In the grinder 1 configured in this manner, when the grinder 1 is turned ON using the switch-operation unit 19, the motor 12 rotates and the rotational output thereof is transmitted to the spindle 24 via a gear mechanism (the bevel gears 20, 22) inside the first gear housing 6. That is, the spindle 24 is rotationally driven by a drive device that includes the motor 12 and the gear mechanism and is housed in the housings 4, 6, 30.

Consequently, when the tool accessory 40 is fixed to the spindle 24 using the lock nut 34, the tool accessory 40 rotates in accordance with the rotation of the spindle 24. The grinder 1 performs processing, such as grinding, polishing, cutting, or the like, on the workpiece by rotating the tool accessory 40. The type or nature of the processing depends on the type of the tool accessory 40 mounted on the spindle 24.

A fan 15, which draws in outside air from an inlet hole of the rear cover 8 and exhausts air via an exhaust hole 7 provided in the first gear housing 6, is provided on the rotary shaft 14 of the motor 12. A protective cover 60, which covers the discoidal (disk-shaped) tool accessory 40, is further provided on the grinder 1 (refer to FIG. 2). The protective cover 60 is also called a wheel cover or a disc cover in the relevant technical field. The phrase "to cover" in the present specification means to at least partially cover an object and, unless otherwise specially mentioned, is not limited to covering the entirety of the object.

Figure 2:
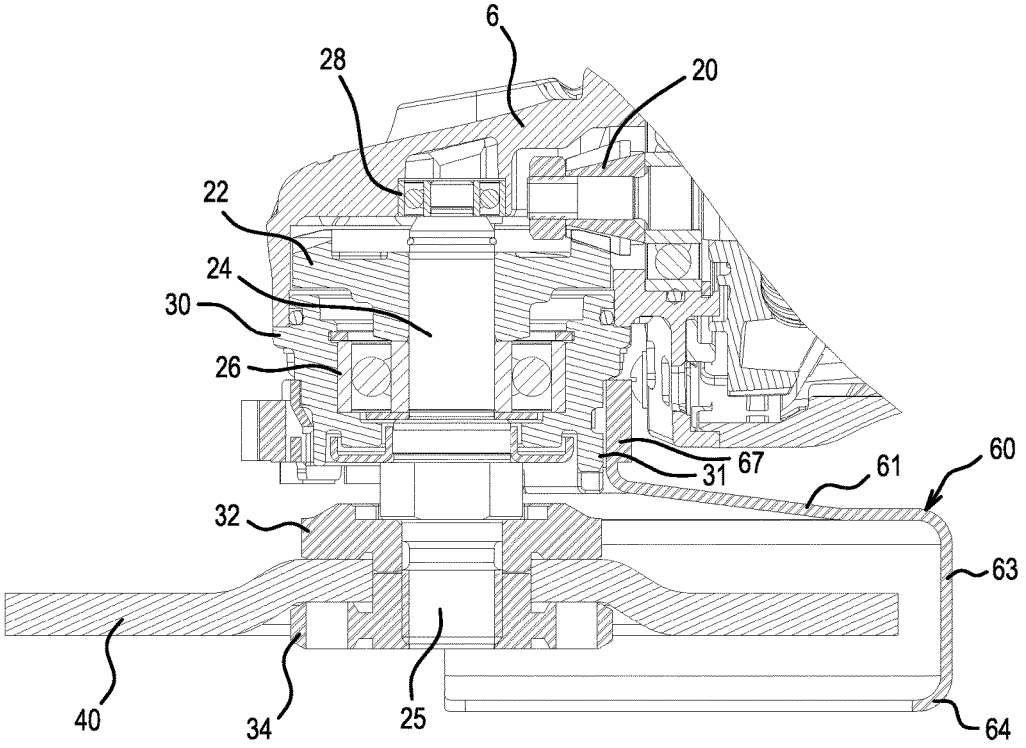
FIG. 2 is a cross-sectional view that shows a region around a spindle of the grinder of FIG. 1 wherein a conventional protective cover is mounted on the grinder.

FIG. 2 shows a cross-sectional configuration of the periphery of the spindle 24 and the tool accessory 40 with the conventional protective cover 60 mounted on the grinder 1 shown in FIG. 1. The protective cover 60 shown in FIG. 2 comprises: a semicircular upper-part structure 61 for covering a rearward semicircular portion of an upper part of the discoidal (disk-shaped) tool accessory 40; and a side-part structure 63, which extends downward from an outer-circumferential-end edge of the upper-part structure 61. The protective cover 60 is configured by integrally forming the upper-part structure 61 and the side-part structure 63. For example, the upper-part structure 61 and the side-part structure 63 may be integrally formed of a metal material. A curved part 64 is provided at the lower end of the side-part structure 63, and thereby the side-part structure 63 is slightly curved at the lower end toward the inner side in the radial direction.

The protective cover 60 further comprises a circular-tubular part 67 for fixing the protective cover 60 to the second gear housing 30. The circular-tubular part 67 is provided on the upper-part structure 61 and serves as a circular-tubular part that is concentric with an outer-circumferential arc of the upper-part structure 61. The circular-tubular part 67 is designed such that its inner diameter is slightly larger than the outer diameter of a cover-connection part 31, which is provided on the second gear housing 30 and has a circular side surface.

Figure 13:
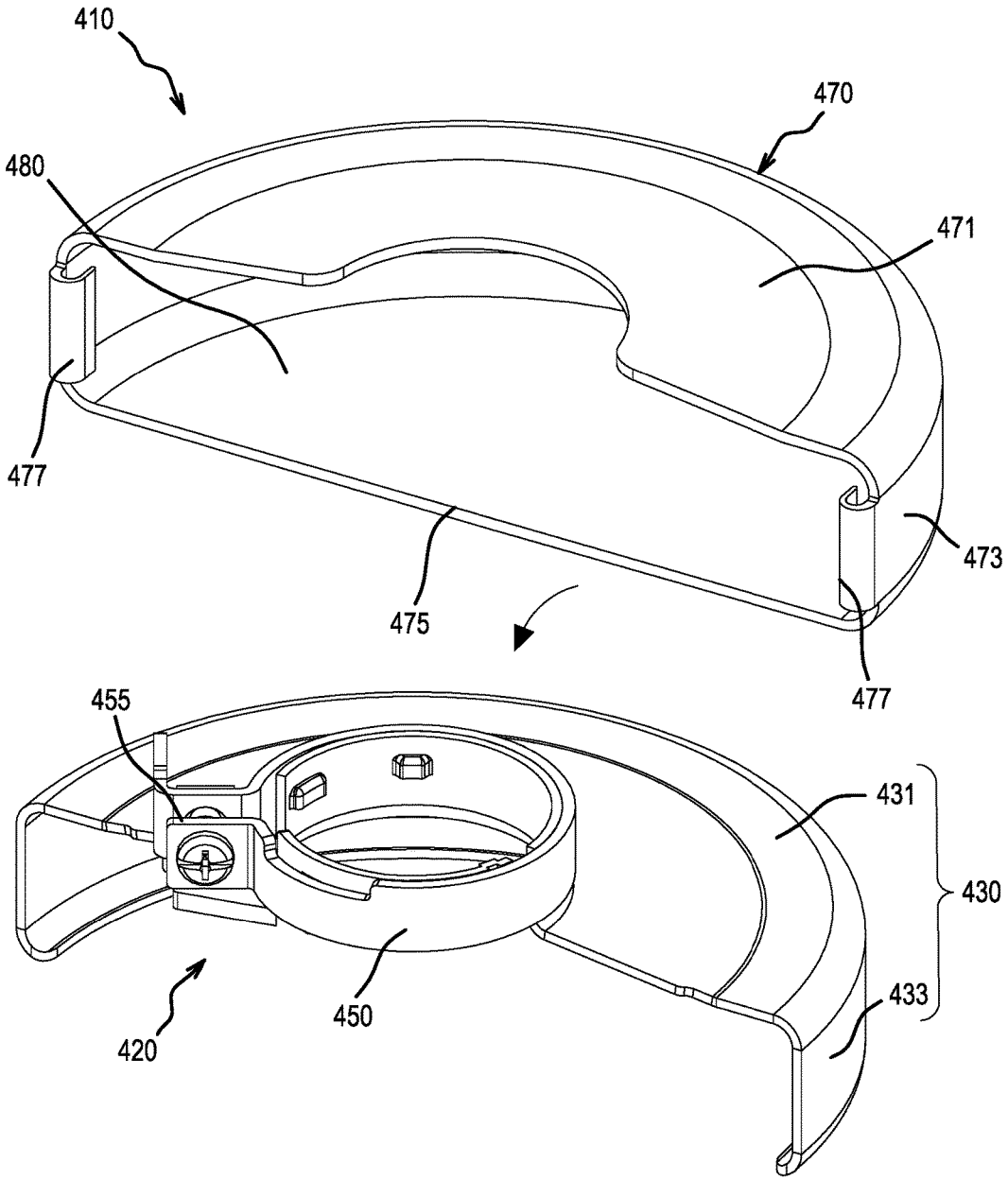
FIG. 13 is an oblique view of a second protective cover according to a fourth embodiment that is configured to be mounted with a first protective cover on a grinder.

Although not shown in FIG. 2, the circular-tubular part 67 is configured such that a section along a plane perpendicular to the up-down direction describes an open-ring shape, and the portion of the circular-tubular part 67 that is open in the circumferential direction is provided with a tightening part for tightening the circular-tubular part 67 to the cover-connection part 31 of the second gear housing 30 on the inner side in the radial direction. A circular-tubular part 450 and a tightening part 455, which have an equivalent configuration, are shown in FIG. 13.

The tightening part functions such that, by changing the positional relationship between a screw and a nut, which sandwich the tightening part from both sides, an inner side of the circular-tubular part 67 is tightened onto the cover-connection part 31 of the second gear housing 30, and thereby the protective cover 60 is fixed to the second gear housing 30. The protective cover 60 shown in FIG. 2 is used when processing the workpiece by using, for example, a grinding stone.

In addition, the protective cover 60 can be attached to the cover-connection part 31 at an arbitrary angle (orientation) in the circumferential direction. The arrangement shown in FIG. 2 is a common arrangement used in grinding. A first protective cover described in each embodiment below likewise can be attached to the grinder at an arbitrary angle. Accordingly, when explaining front, rear, left, and right in relation to the structural elements of the protective cover, the explanations are merely of the directions based on the common arrangement when performing grinding, and it should be understood that the orientation of the circumferential direction of the protective cover with respect to the grinder is not limited to any specific direction.

First Embodiment

The grinder 100 according to a first embodiment is configured such that a first protective cover 120 and a second protective cover 170, which serve as a protective-cover set 110 and are shown in FIG. 3 to FIG. 6, are mounted on the grinder 1 shown in FIG. 1 or on a similar grinder.

The first protective cover 120 comprises a cover main body 130, which extends in the circumferential direction of the spindle 24, and a lever-fixing part 150, which is for fixing the cover main body 130 to the second gear housing 30. Similar to the protective cover 60 discussed above, the cover main body 130 comprises: a semicircular upper-part structure 131 for covering the rearward semicircular portion of the upper part of the tool accessory 40; and a side-part structure 133 that extends downward from an outer-circumferential-end edge of the upper-part structure 131. Based on this configuration, the cover main body 130 functions to cover the tool accessory 40 from above and the side, extending in the circumferential direction of the spindle 24. The upper-part structure 131 and the side-part structure 133 are integrally formed of, for example, a metal material. The side-part structure 133 comprises, at its lower end, a curved part (not shown) that curves toward the inner side in the radial direction.

The lever-fixing part 150 is provided on the upper-part structure 131, which serves as a ring-shaped member that is configured to be tightened toward the inner side in the radial direction by a lever 155. The upper-part structure 131 has an extended portion, which extends upward and around the circumference of the cover-connection part 31 of second gear housing 30, and is connected to the lever-fixing part 150 by this extended portion.

Figure 3:
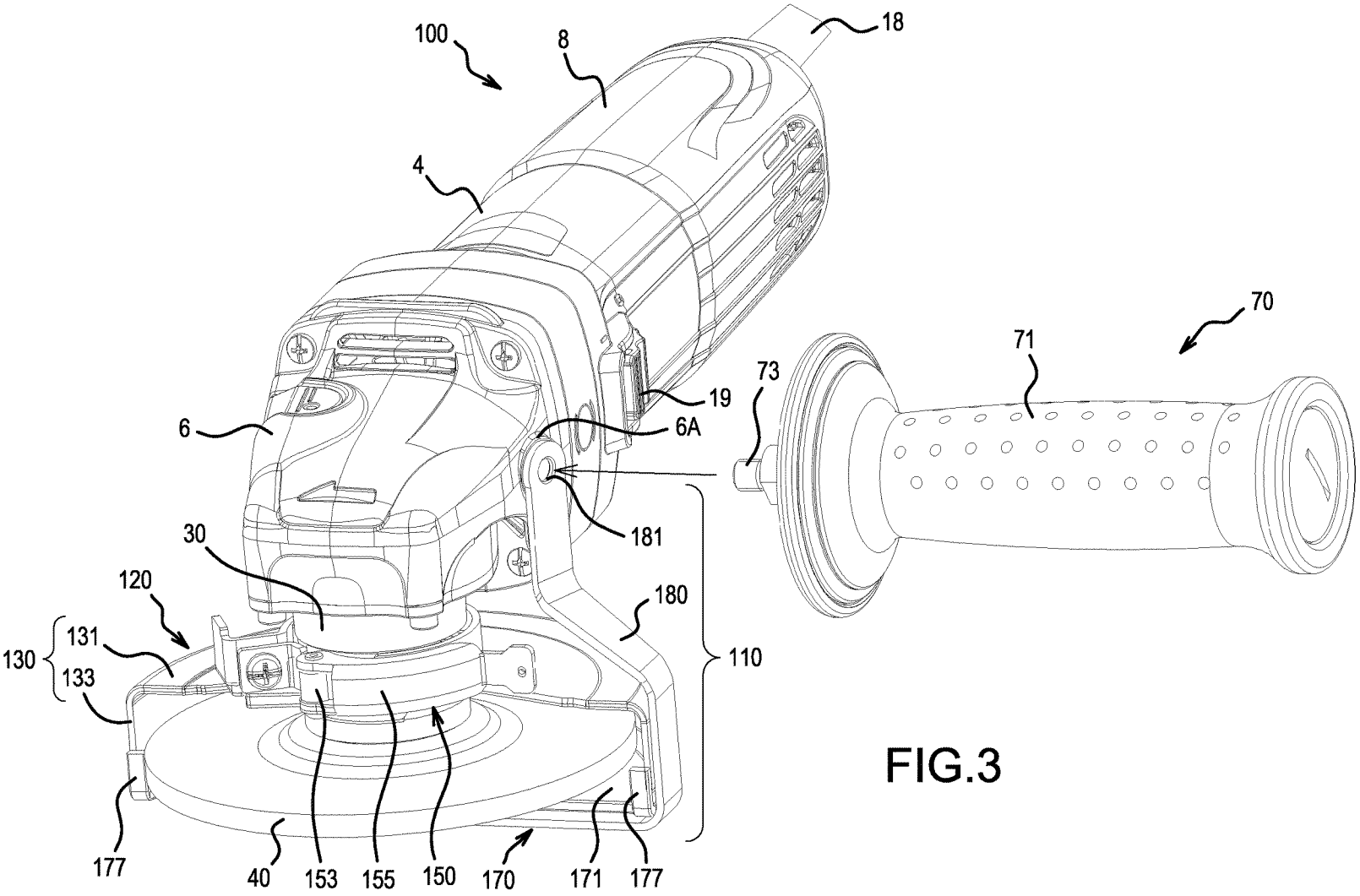
FIG. 3 is an oblique view, viewed from the front, of a grinder according to a first embodiment, the grinder including a first protective cover and a second protective cover.

As shown in FIG. 3, the lever-fixing part 150 comprises the lever 155, which pivots around a pivot shaft 153, and functions to tighten the inner side of the lever-fixing part 150 to the cover-connection part 31 of the second gear housing 30 when the lever 155 is clamped down toward the inner side in the radial direction.

Owing to the function of the lever-fixing part 150, the first protective cover 120 is fixed to the second gear housing 30. After the first protective cover 120 is fitted onto the cover-connection part 31 of the second gear housing 30, the first protective cover 120 is fixed to the cover-connection part 31 by being tightened thereto.

Figure 4:
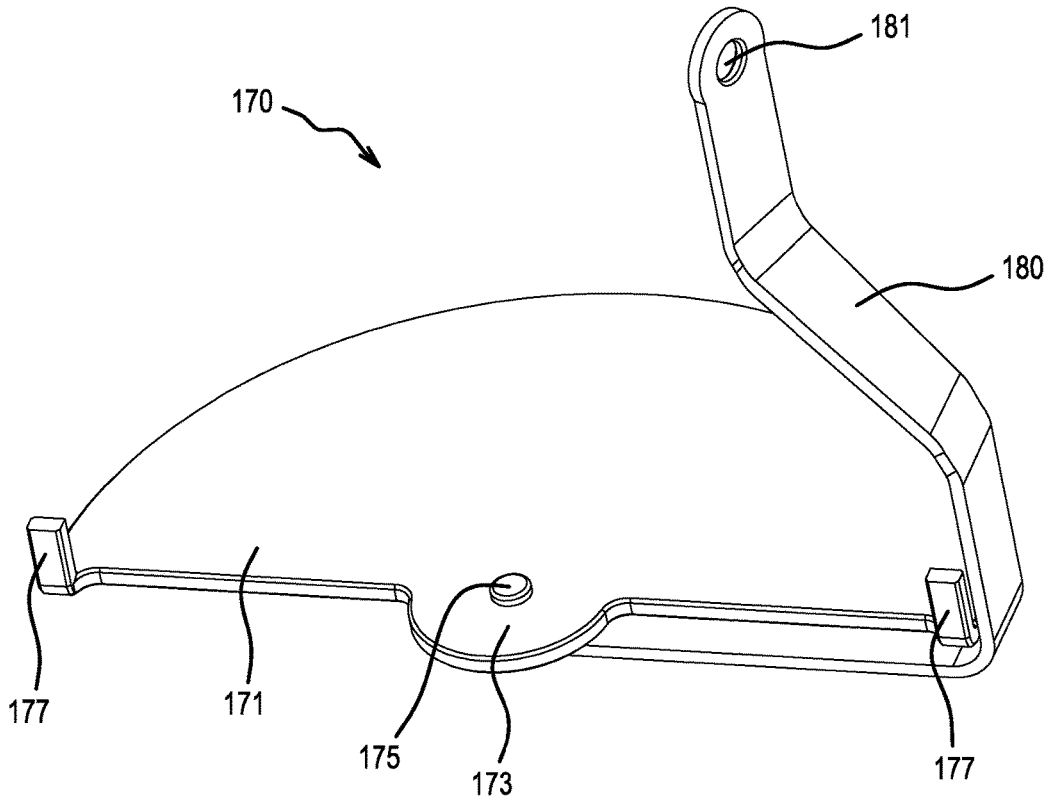
FIG. 4 is an oblique view of the second protective cover shown in FIG. 3.

As shown in FIG. 3 and FIG. 4, the second protective cover 170 is detachably fixed, independently of the first protective cover 120, to the first gear housing 6 of the grinder 100. As shown in FIG. 3, the grinder 100 comprises, on the left and right sides of the surface of the first gear housing 6, a pair of grip-fixing parts 6A for detachably fixing a grip 70 that is gripped by the user. The grip-fixing parts 6A are implemented as screw holes. The grip 70 comprises a screw part 73 at one end of a grip main body 71 and is fixed to the first gear housing 6 by screwing the screw part 73 into one of the grip-fixing parts 6A.

The second protective cover 170 is detachably fixed to the first gear housing 6 via the relevant grip-fixing part 6A and, below the first protective cover 120, covers an area below the tool accessory 40 that is not covered by the first protective cover 120. Specifically, the second protective cover 170 comprises a cover main body 171, which covers (underlies) the first protective cover 120 from below, and a holder 180, which holds the cover main body 171 below the first protective cover 120.

The holder 180 is composed of an elongated plate-shaped member as shown in FIG. 4. The holder 180 comprises, at one end, a through hole 181; the screw part 73 of the grip 70 passes through the through hole 181 into the grip-fixing part 6A. As shown in FIG. 3, when the screw part 73 has been inserted through the through hole 181, the holder 180 is sandwiched between the grip 70 and the grip-fixing part 6A by the grip 70 being screw-fastened to the grip-fixing part 6A. Owing to this sandwiching, the second protective cover 170 is fixed to the first gear housing 6 via the grip-fixing part 6A. The second protective cover 170 may be fixed via the grip-fixing part 6A using a common screw instead of the screw part 73 of the grip 70.

Figure 5:
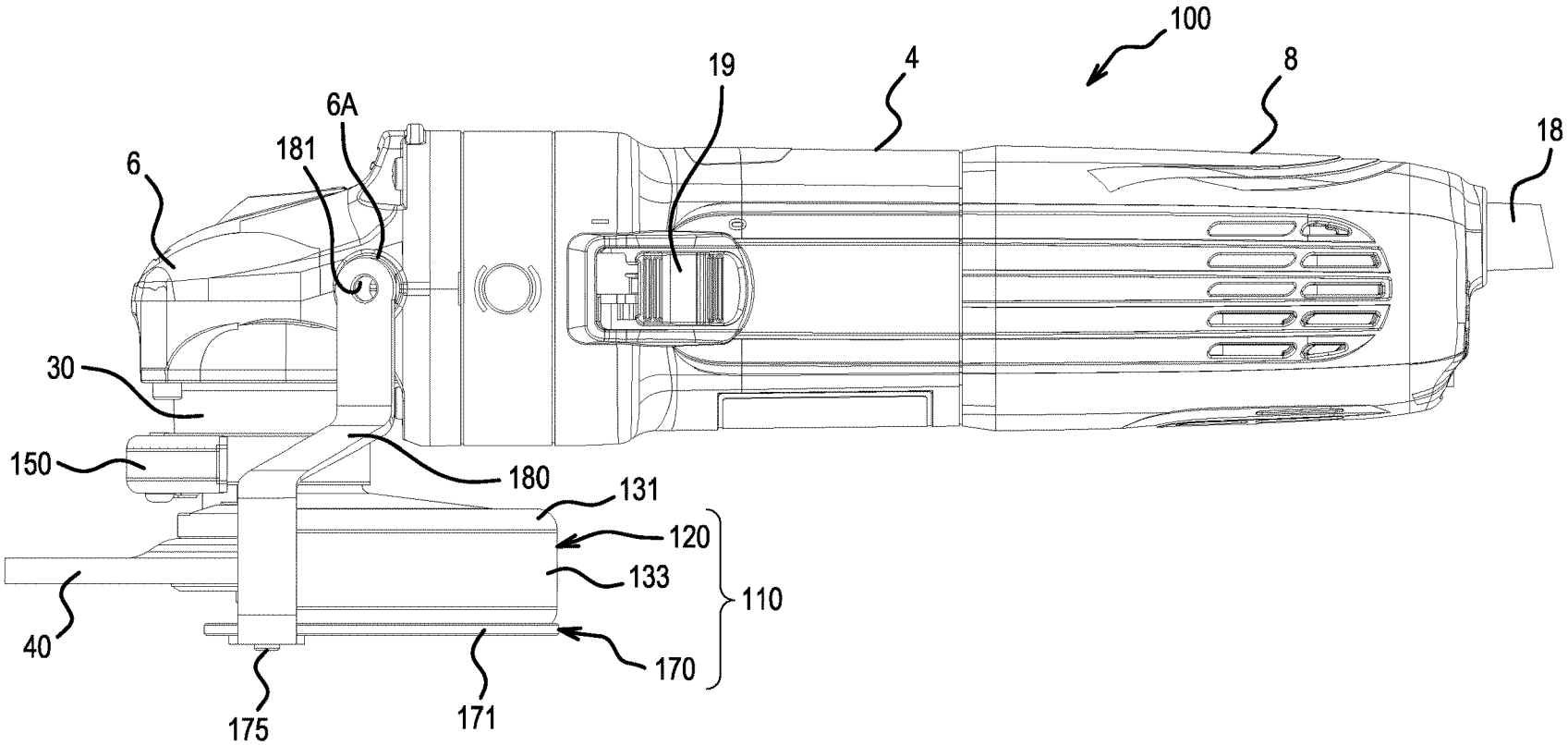
FIG. 5 is a side view of the grinder according to the first embodiment with the second protective cover mounted in a first orientation.
Figure 6:
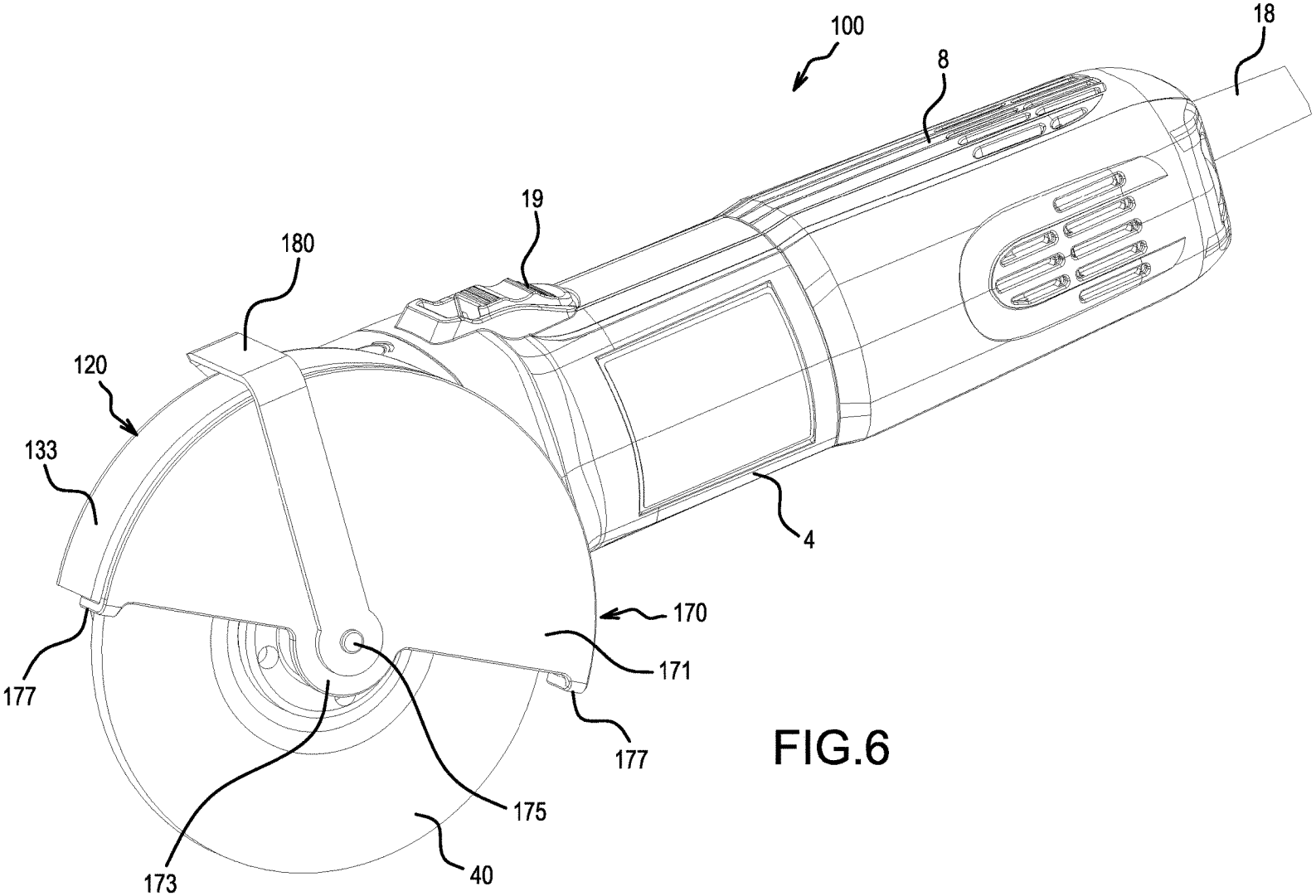
FIG. 6 is an oblique view, viewed from below, of the grinder according to the first embodiment with the second protective cover mounted in a second orientation.

As shown in FIG. 3 and FIG. 5, the holder 180 is configured such that, when the holder 180 is fixed to the first gear housing 6, the plate-shaped member extends downward from one end, in which the through hole 181 is provided, passing along the sides of the first and second gear housings 6, 30 and the first protective cover 120 so as to avoid the first protective cover 120. Furthermore, the holder 180 is configured such that it curves where the plate-shaped member passes by the lower end of the first protective cover 120 and extends along the plane perpendicular to the up-down direction to the spot at which it overlaps the axis line of the spindle 24. At the end opposite from the one end at which the grip-fixing parts 6A are fixed, the holder 180 rotatably holds the cover main body 171 via a pivot pin 175.

The cover main body 171 is composed of a semicircular metal plate or resin plate, corresponding to the shape of the first protective cover 120, and is held below the spindle 24 by the holder 180 such that the cover main body 171 can rotate in the circumferential direction (in the rotational direction or outer-circumferential direction of the spindle 24).

That is, the cover main body 171 is held by the holder 180 such that the cover main body 171 can rotate around an axis that passes through the center of a circle that follows along the outer circumference of the cover main body 171. The cover main body 171 comprises a connection part 173, which connects with the holder 180 in the vicinity of the center of the circle that follows along the outer circumference of the cover main body 171, and is rotatably connected to the holder 180 at the connection part 173 by the pivot pin 175.

The cover main body 171 further comprises extension parts 177, which face upward, on both the left and right ends of the cover main body 171. When the cover main body 171 is disposed below the first protective cover 120, the extension parts 177 engage with the side-part structure 133 of the first protective cover 120 and hold the cover main body 171 such that it does not pivot with respect to the first protective cover 120. The structure by which the cover main body 171 pivots with respect to the holder 180 is provided in order to dispose the cover main body 171 below the first protective cover 120 in accordance with the orientation of the circumferential direction of the first protective cover 120, which is mounted on the cover-connection part 31 of the second gear housing 30.

According to the present embodiment, the second protective cover 120 is provided independently of the first protective cover 120 (which has the same configuration as the conventional protective cover 60), and the second protective cover 120 is detachably fixed to the grip-fixing part 6A. Accordingly, as needed, the user can adjust the area over which the tool accessory 40 is covered by simply mounting or dismounting the second protective cover 170. As a result, according to the present embodiment, the work efficiency and the dust-dispersion-reduction performance of the grinder 100 are improved.

That is, if the user is to perform grinding work using a grinding stone as the tool accessory 40, then the user can perform the processing work using the lower surface of the tool accessory 40 when the first protective cover 120 alone is mounted on the grinder 100 without mounting the second protective cover 170.

On the other hand, if the user is to perform cutting work using a cutting stone as the tool accessory 40, then, the user can fix the second protective cover 170 below the first protective cover 120 via the grip-fixing part 6A and thereby can perform the cutting work with the tool accessory 40 covered by the cover main body 171 from below.

If a cutting stone is used as the tool accessory 40, then the tool accessory 40 is disposed perpendicular to the workpiece, and the workpiece is processed using the side edge of the tool accessory 40. In this state, there is a possibility that the underside of the tool accessory 40 will face toward the user. Accordingly, by mounting the second protective cover 170 such that the area below the tool accessory 40 is covered, the user can perform cutting work in an environment that is more favorable than the case in which the second protective cover 170 is not mounted. In the grinder 100 shown in FIG. 6, the orientation of the circumferential direction of the first protective cover 120 is adjusted to an orientation that is suited to cutting work; in accordance with that orientation, the orientation of the cover main body 171 likewise can be adjusted by pivoting from the orientation of the holder 180.

Second Embodiment

Figure 7:
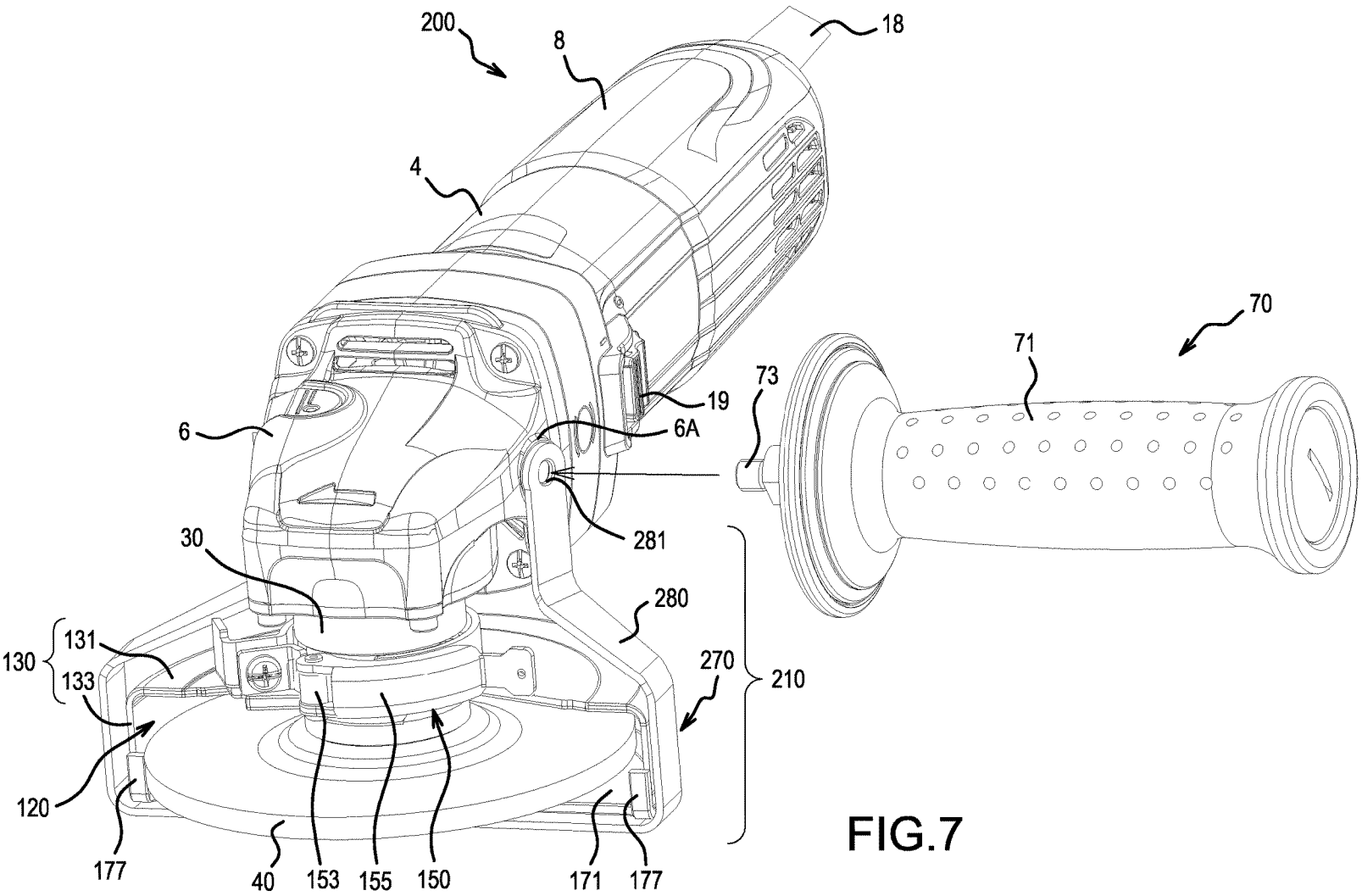
FIG. 7 is an oblique view, viewed from the front, of a grinder according to a second embodiment, the grinder including a first protective cover and a second protective cover.

The grinder 200 according to a second embodiment is configured such that the first protective cover 120, which has the same configuration as in the first embodiment, is mounted on the cover-connection part 31 of the second gear housing 30 of the grinder 1 shown in FIG. 1 or of a similar grinder. Furthermore, according to the present embodiment, a second protective cover 270, which is configured to be mounted on and dismounted from the grinder main body, is provided independently of the first protective cover 120. That is, according to the present embodiment, the combination of the first protective cover 120 and the second protective cover 270 shown in FIG. 7 and FIG. 8 is provided as a protective-cover set 210.

The second protective cover 270 of the present embodiment is configured such that the cover main body 171, which has the same configuration as in the first embodiment, is pivotably connected to a holder 280 that is characteristic of the present embodiment. The holder 280 is configured such that a portion of the holder 280 corresponding to the shape of the holder 180 of the first embodiment is provided with left-right symmetry (planar symmetry) with reference to the plane extending in the front-rear direction and passing through the axis line (the rotary shaft of the pivot pin 175) of the spindle 24.

Figure 8:
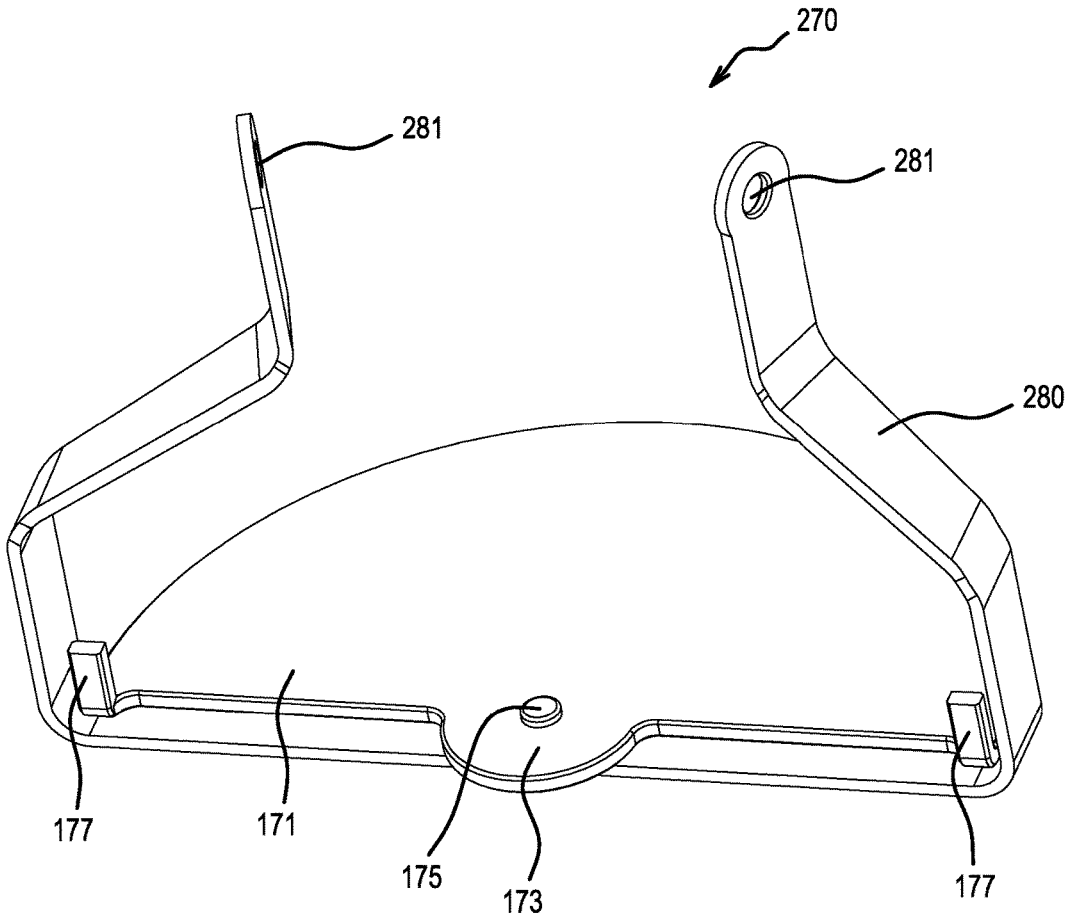
FIG. 8 is an oblique view of the second protective cover of FIG. 7 detached from the grinder.

The holder 280 is composed of an elongated plate-shaped member as shown in FIG. 8. The holder 280 comprises, at both ends, through holes 281. The holder 280 is screw-fastened to the left and right grip-fixing parts 6A by inserting the screw part 73 of the grip 70 through one of the two through holes 281 and a general-purpose screw through the other of the two through holes 281. Owing to this screw-fastening, the second protective cover 270 is fixed to the first gear housing 6 by the grip-fixing parts 6A.

The holder 280 is configured such that, when it is fixed to the first gear housing 6, the plate-shaped member extends from the end parts at which the through holes 281 are provided downward, past the sides of the first and second gear housings 6, 30 and the first protective cover 120 so as to avoid the first protective cover 120. Further, the holder 280 is configured such that it curves where the plate-shaped member passes by the lower end of the first protective cover 120 and extends along the plane perpendicular to the up-down direction to the spot at which it overlaps the axis line of the spindle 24. The holder 280 rotatably holds, via the pivot pin 175, the cover main body 171 at the location at which the holder 280 overlaps the axis line of the spindle 24. According to the present embodiment, it is possible to stably and rigidly fix the second protective cover 270 via the left and right grip-fixing parts 6A.

Third Embodiment

The grinder 300 according to a third embodiment is configured such that the first protective cover 120, which has the same configuration as in the first embodiment, is mounted on the cover-connection part 31 of the second gear housing 30 of the grinder 1 shown in FIG. 1 or of a similar grinder. Furthermore, according to the present embodiment, a second protective cover 370, which is configured to be mounted on and dismounted from the grinder main body, is provided independently of the first protective cover 120. That is, according to the present embodiment, the combination of the first protective cover 120 and the second protective cover 370 shown in FIG. 9 to FIG. 12 is provided as a protective-cover set 310.

The second protective cover 370 according to the present embodiment is configured such that the cover main body 171, which has the same configuration as in the first embodiment, is pivotably connected to a holder 380, which is characteristic of the present embodiment. The holder 380 has a configuration wherein the holder 380, which unlike the cover main body 171 is fixed (can not rotate) with respect to the grinder 300, is prevented from interfering with the workpiece, and thereby it is possible to prevent a reduction in work efficiency. That is, unlike the first embodiment and the second embodiment, the holder 380 is configured such that it passes toward the rear of the first protective cover 120 rather than at the front of the first protective cover 120 and pivotably holds the cover main body 171.

Figure 10:
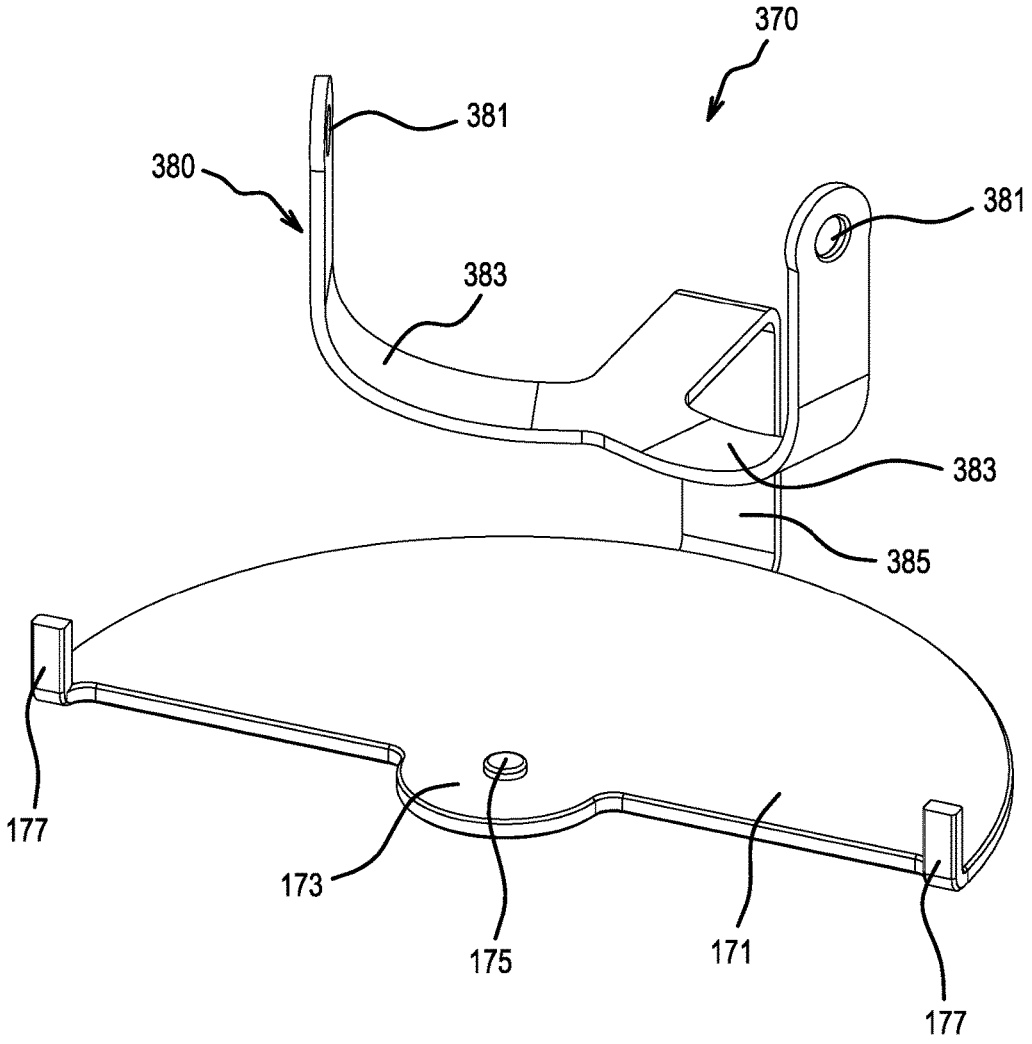
FIG. 10 is an oblique view of the second protective cover of the grinder of FIG. 9.

As shown in FIG. 10, the holder 380 has a shape that has left-right symmetry (plane symmetry) with reference to the plane extending in the front-rear direction and passing through the axis line (the rotary shaft of the pivot pin 175) of the spindle 24. The holder 380 comprises two through holes 381 that correspond to the left and right grip-fixing parts 6A. The holder 380 is screw-fastened to the left and right grip-fixing parts 6A by inserting the screw part 73 of the grip 70 in one of the two through holes 381 and a general-purpose screw through the other of the two through holes 381. Owing to the screw-fastening, the second protective cover 370 is fixed to the first gear housing 6 via the grip-fixing parts 6A.

Figure 9:
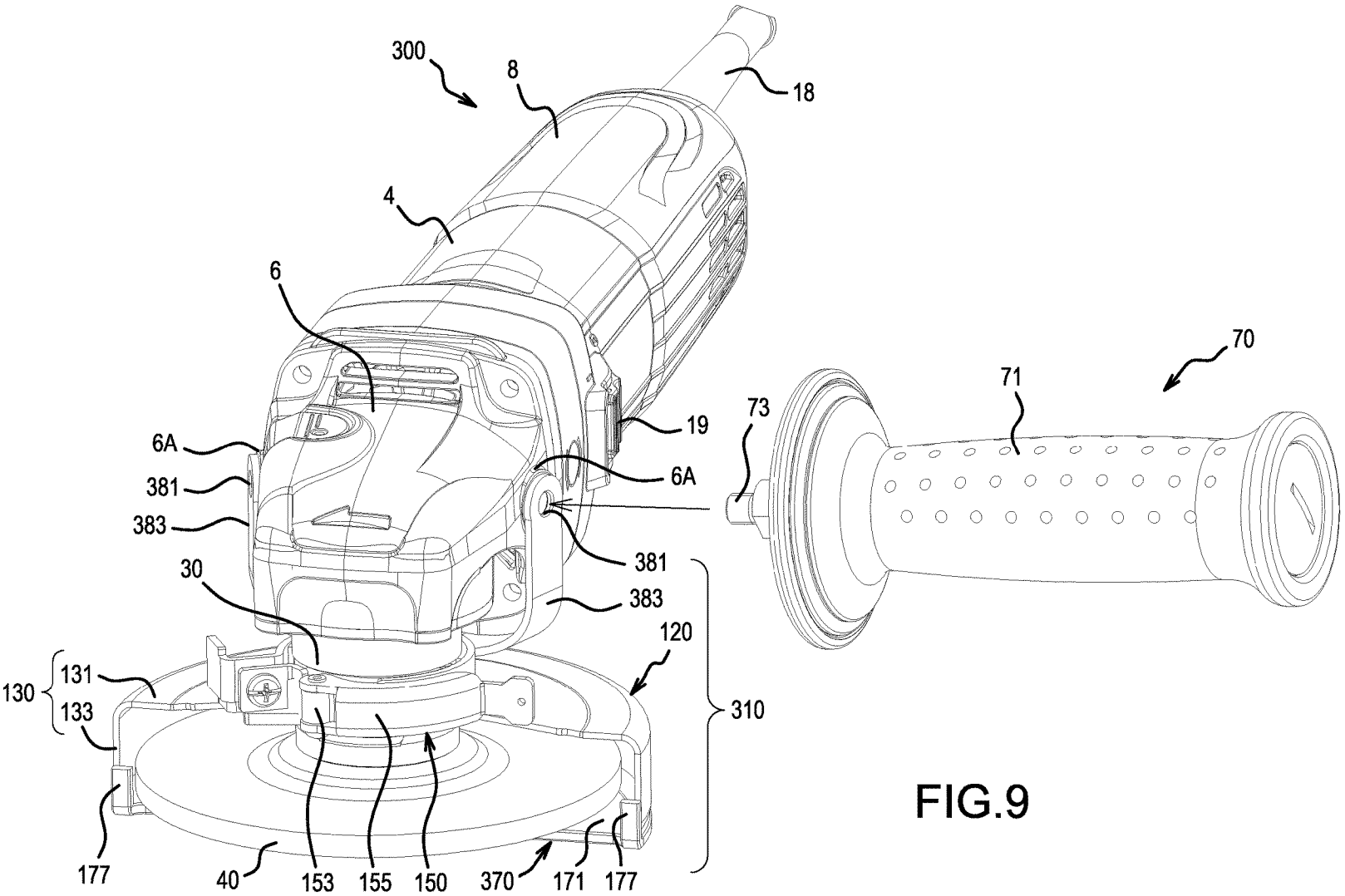
FIG. 9 is an oblique view, viewed from the front, of a grinder according to a third embodiment, the grinder including a first protective cover and a second protective cover.
Figure 11:
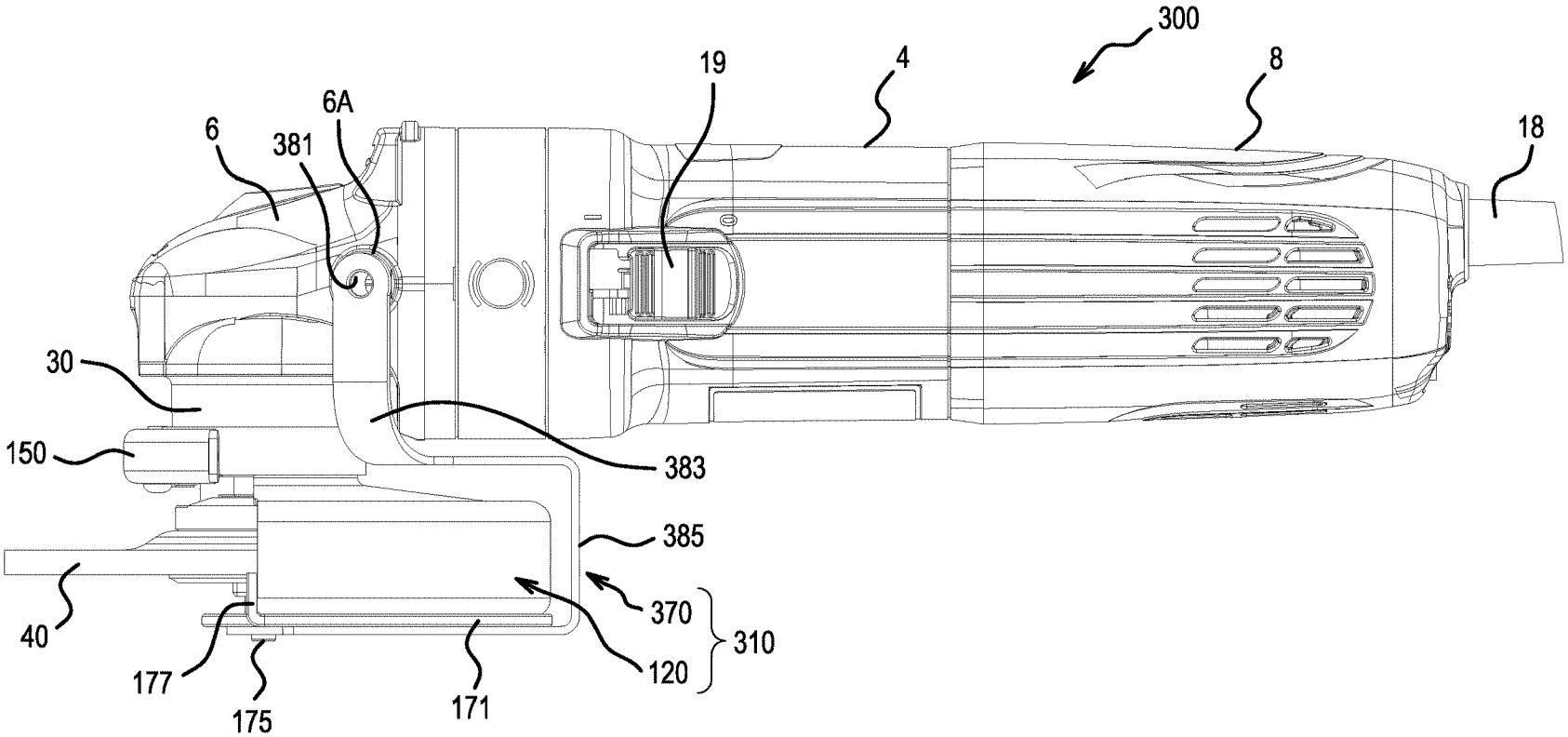
FIG. 11 is a side view of the grinder according to the third embodiment.

As shown in FIG. 9 and FIG. 11, the holder 380 is configured such that, when the holder 380 is fixed to the first gear housing 6, two connection parts 383, in which the through holes 381 are provided, extend such that they curve toward the rear of the second gear housing 30. The two connection parts 383 are configured such that they are coupled to a cover-main-body holding part 385 rearward of the second gear housing 30. The cover-main-body holding part 385 is configured such that, from the rear of the second gear housing 30, it extends downward, passing rearward of the first protective cover 120.

The cover-main-body holding part 385 is configured such that it curves at the spot at which it passes by the lower end of the first protective cover 120 and extends along the plane perpendicular to the up-down direction to the spot at which it overlaps the axis line of the spindle 24. At the spot at which it overlaps the axis line of the spindle 24, the cover-main-body holding part 385 pivotably holds the cover main body 171 via the pivot pin 175.

According to the present embodiment, the possibility that the holder 380 will interfere with the workpiece during processing work can be reduced because the holder 380 passes rearward and extends to the grip-fixing parts 6A of the first gear housing 6 without extending to the left and right from the pivot part at which the cover main body 171 overlaps the axis line of the spindle 24.

Figure 12:
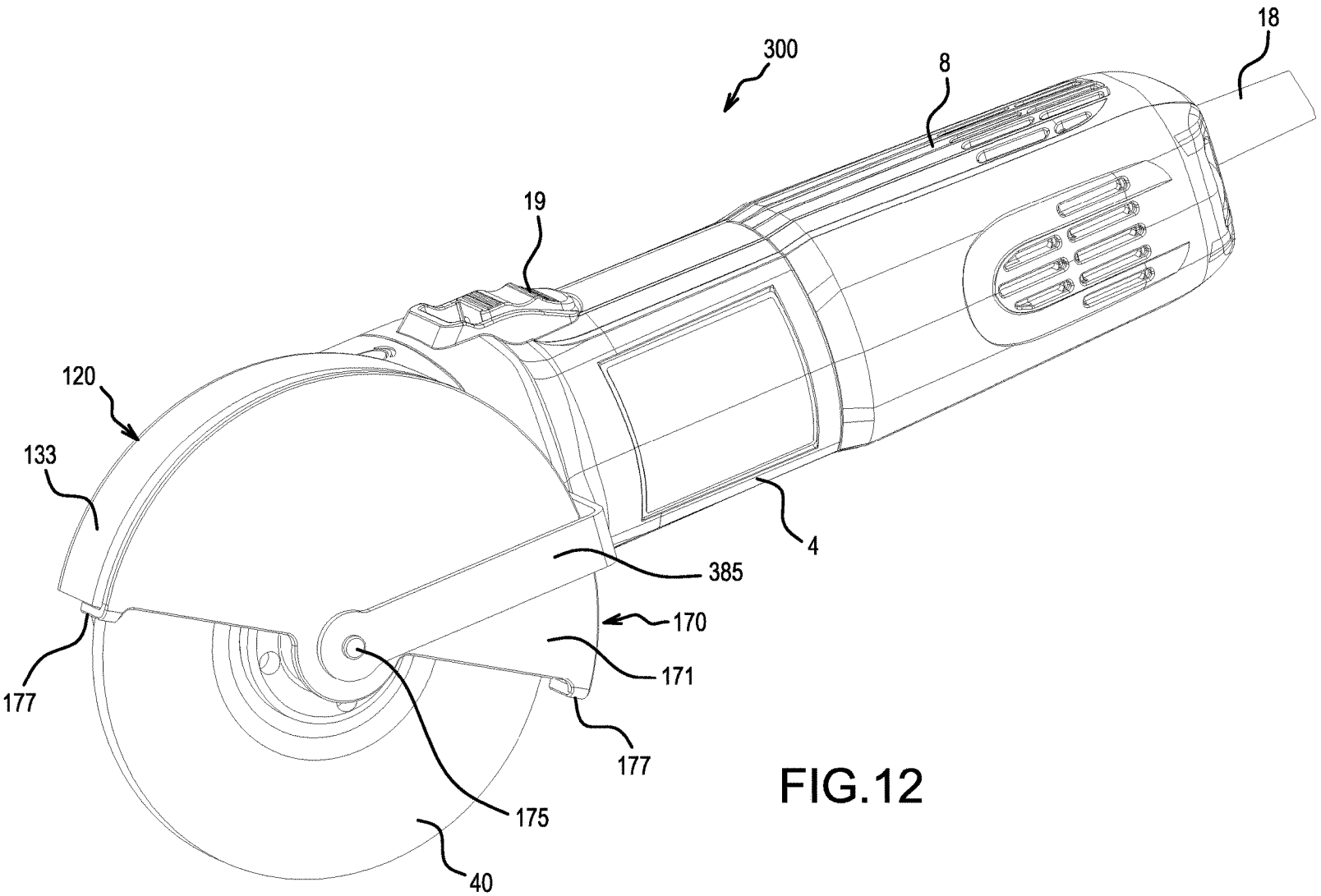
FIG. 12 is an oblique view, viewed from below, of the grinder according to the third embodiment.

In the grinder 300 shown in FIG. 12, the circumferential orientation of the of the first protective cover 120 is adjusted to an orientation that is suited to cutting work, and, in accordance with that orientation, the orientation of the cover main body 171 is likewise adjusted by pivoting relative to the holder 380. According to the present embodiment, in such a state as well, the holder 380 is connected to the cover main body 171 through the area below the tool accessory 40 covered by the first protective cover 120. Accordingly, the possibility that the holder 380 will interfere with the workpiece during processing work can be reduced.

The holder 380 passing rearward of the first protective cover 120 corresponds to passing through the space between the user, who is holding (gripping) the grinder 300, and the first protective cover 120, passing via the side that is gripped by the user of the grinder 300, passing via the side opposite the portion of the tool accessory 40 that makes contact with the workpiece during processing work, passing via a location spaced apart from that portion, or passing via the side opposite the side on which the spindle 24 of the elongate grinder 300 and the tool accessory 40 are located.

Fourth Embodiment

The grinder 400 according to a fourth embodiment is configured such that a first protective cover 420, which has a configuration similar to that of the first through third embodiments, is mounted on the cover-connection part 31 of the second gear housing 30 of the grinder 1 shown in FIG. 1 or of a similar grinder.

Furthermore, according to the present embodiment, a second protective cover 470, which is configured to be mounted on and dismounted from the first protective cover 420, is provided. That is, according to the present embodiment, the combination of the first protective cover 420 and the second protective cover 470 shown in FIG. 13 to FIG. 15 is provided as a protective-cover set 410.

Figure 14:
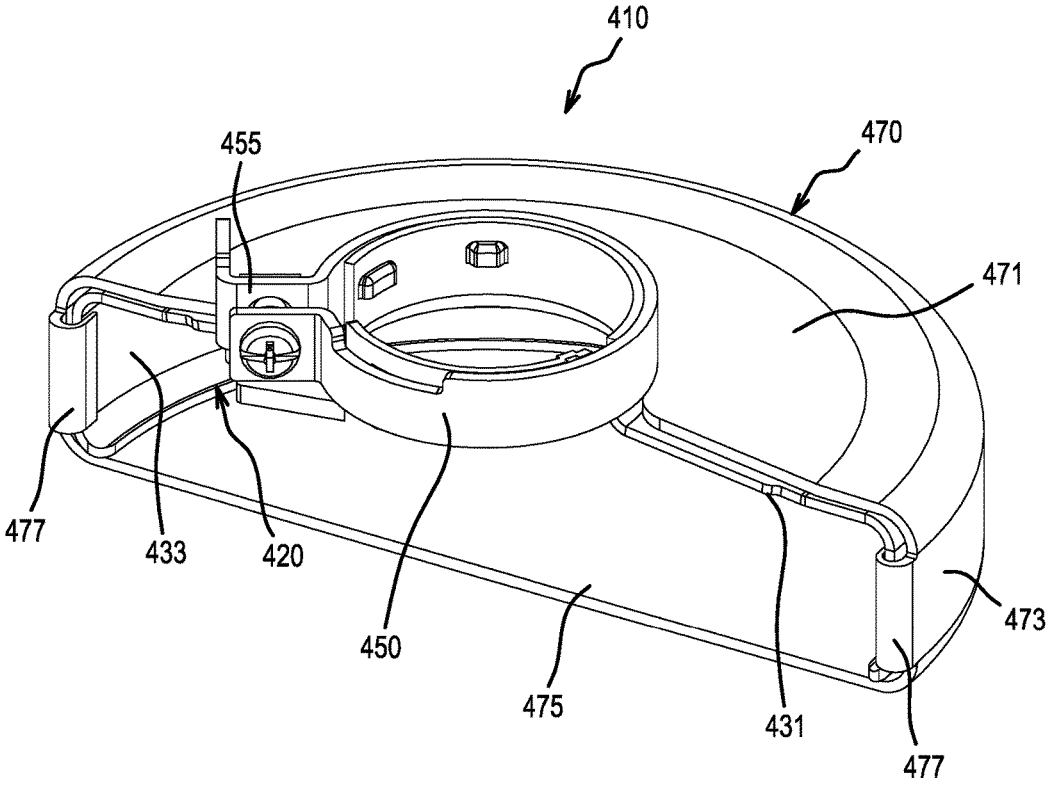
FIG. 14 is an oblique view of the second protective cover of FIG. 13, which is mounted on the first protective cover, according to the fourth embodiment.
Figure 15:
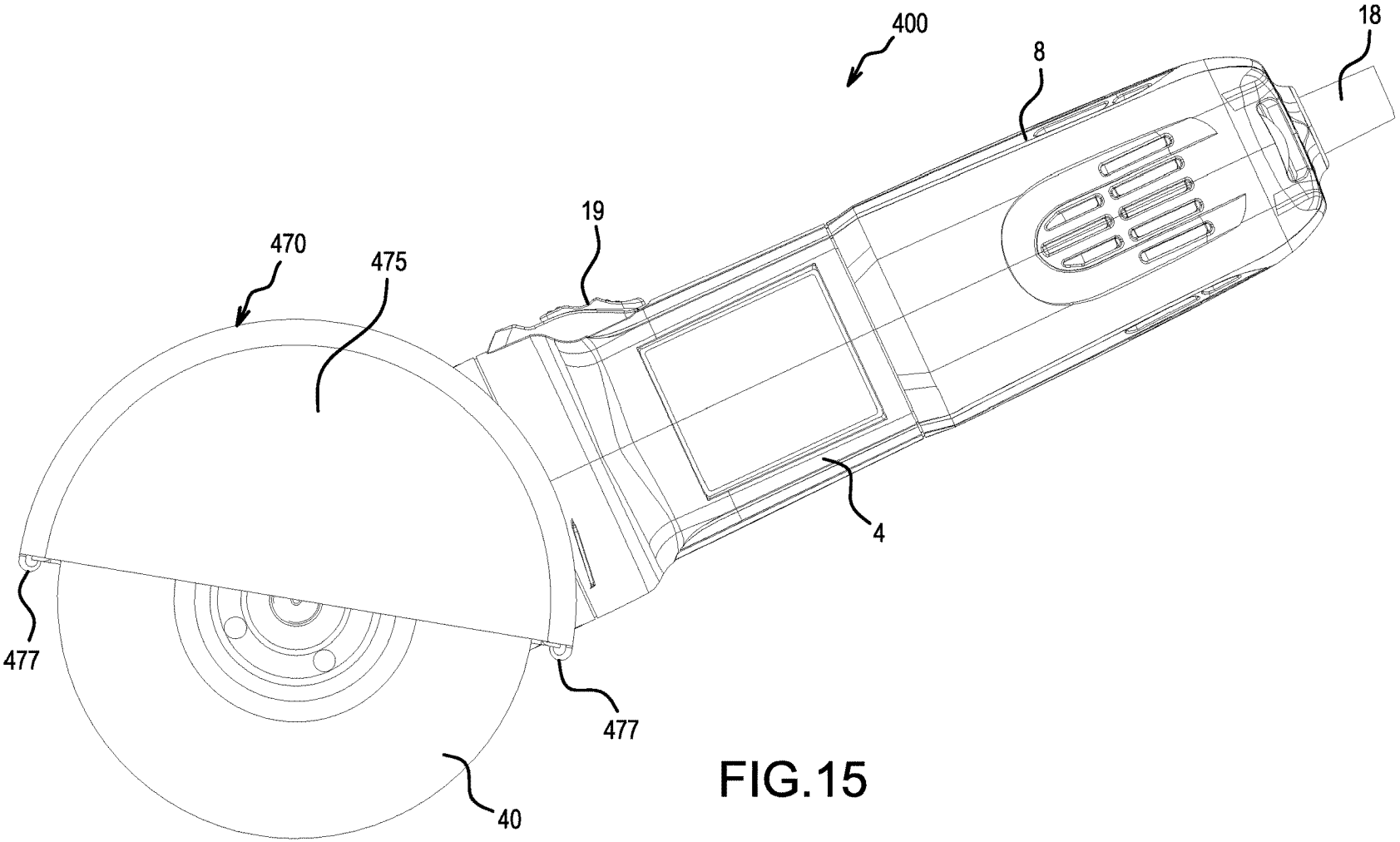
FIG. 15 is a bottom view of the grinder according to the fourth embodiment.
Figure 16:
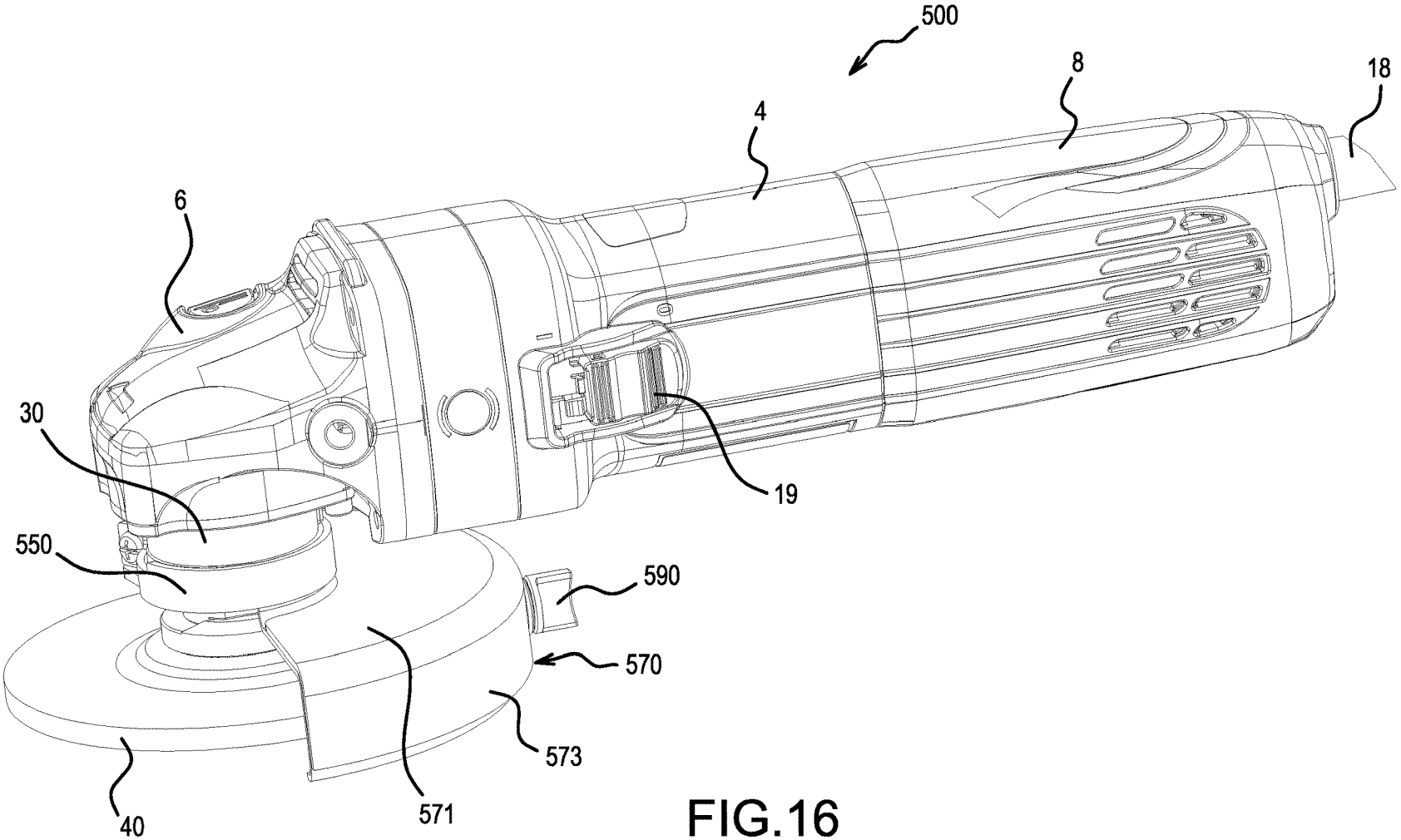
FIG. 16 is an oblique view that shows a first aspect of a grinder according to a fifth embodiment, the grinder including a first protective cover and a second protective cover.
Figure 17:
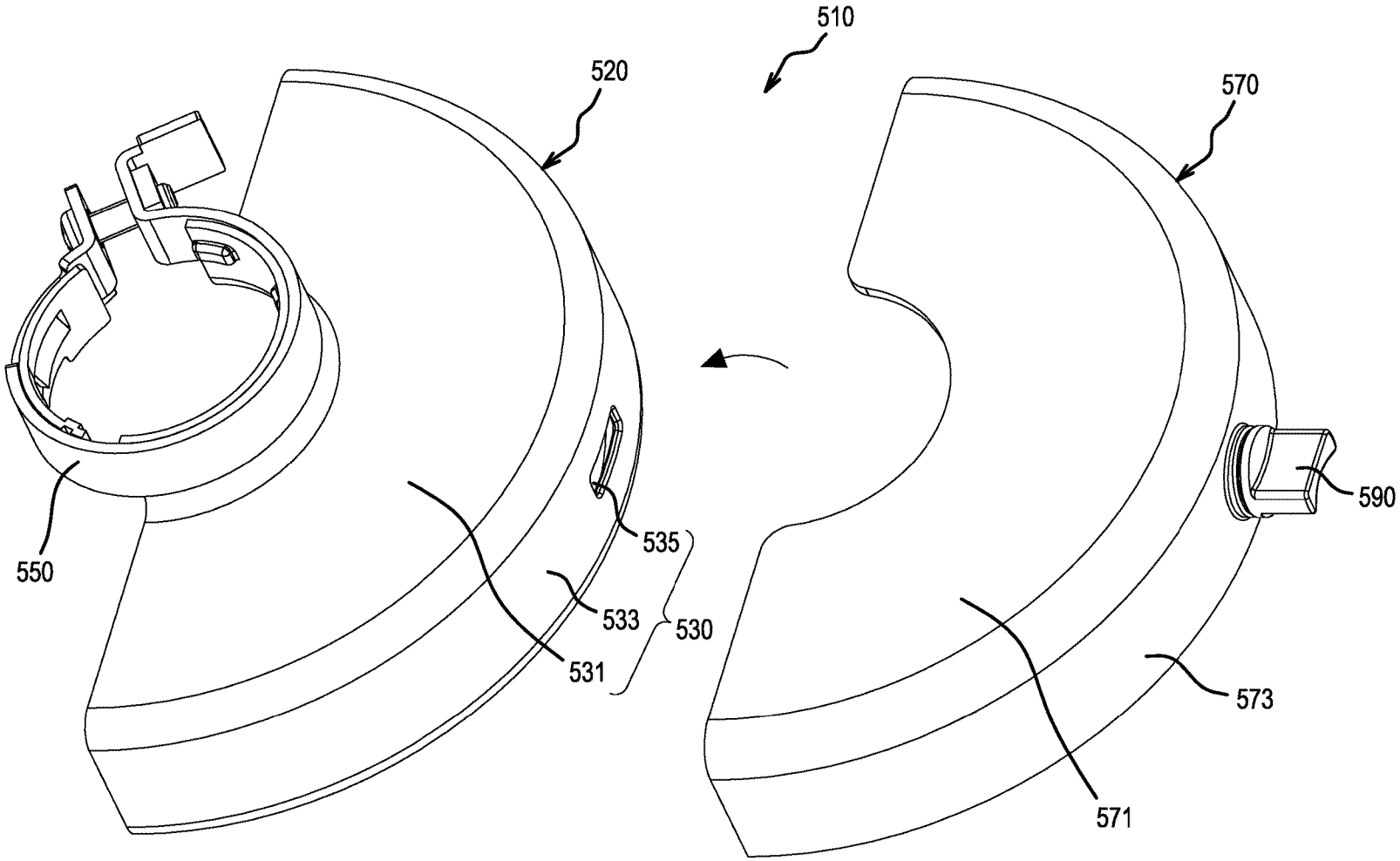
FIG. 17 is an oblique view of the first protective cover and the second protective cover, according to the fifth embodiment, of FIG. 16 before the second protective cover is mounted, such that it is upward facing, on the first protective cover.
Figure 18:
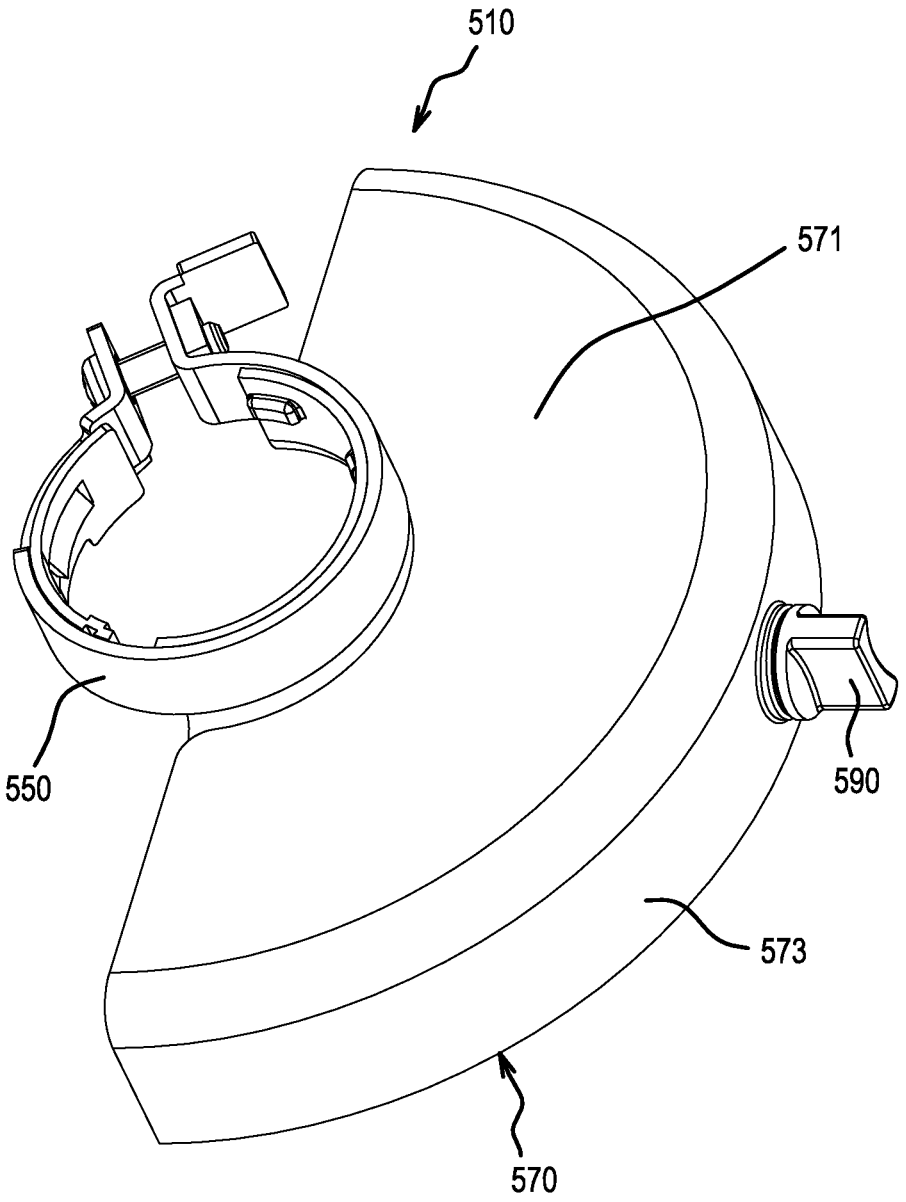
FIG. 18 is an oblique view of the first protective cover and the second protective cover, according to the fifth embodiment, after the second protective cover is mounted and fixed, such that it is upward facing, onto the first protective cover.

According to the present embodiment, the area below the tool accessory 40 covered by the protective-cover set 410 is changed by the second protective cover 470 being mounted on and dismounted from the first protective cover 420, which is fixed to the cover-connection part 31 of the second gear housing 30, as shown in FIG. 13 and FIG. 14.

The first protective cover 420 comprises a cover main body 430, which is configured the same as the protective cover 60 described above and extends in the circumferential direction of the spindle 24, and the circular-tubular part 450, which is for fixing the cover main body 430 to the second gear housing 30.

The cover main body 430 comprises a semicircular upper-part structure 431 and a side-part structure 433, which extends downward from an outer-circumferential-end edge of the upper-part structure 431. Based on this configuration, the cover main body 430 functions to cover the tool accessory 40 from above and the side, extending in the circumferential direction of the spindle 24. The upper-part structure 431 and the side-part structure 433 are integrally formed of, for example, a metal material.

The upper-part structure 431 has an extended portion that extends upward at a location corresponding to the circular-tubular part 450 and is connected to the circular-tubular part 450 at this extended portion. The circular-tubular part 450 is integrally configured with the extended portion or is configured as a structure separate from the extended portion.

As shown in FIG. 13, the circular-tubular part 450 is formed into an open-ring shape, the same as in the circular-tubular part 67; on a portion that is open in the circumferential direction, a tightening part 455 is provided for tightening the circular-tubular part 450 onto the cover-connection part 31 of the second gear housing 30.

The tightening part 455 functions such that, by changing the positional relationship between a screw and a nut that sandwich the tightening part 455 on both sides, an inner side of the circular-tubular part 450 is tightened to the cover-connection part 31 of the second gear housing 30. Owing to the function of the circular-tubular part 450, the first protective cover 420 is fixed to the second gear housing 30.

The second protective cover 470 is entirely composed of an elastic material, e.g., a rubber material. As used herein, "elastic" refers to a material that preferably has a Young's modulus of equal to or less than about 0.1, more preferably equal to or less than 0.05. The second protective cover 470 comprises: a semicircular upper-part structure 471, which is designed to cover an upper surface of the cover main body 430 that constitutes the first protective cover 420; a side-part structure 473, which extends downward from an outer-circumferential-end edge of the upper-part structure 471; and a lower-part structure 475, which extends, from a lower end of the side-part structure 473, along the plane perpendicular to the up-down direction toward the inner side in the radial direction (the axis line side of the spindle 24). The lower-part structure 475 is provided in order to cover the area below the tool accessory 40 not covered by first protective cover 420 when the second protective cover 470 is mounted on the first protective cover 420.

The second protective cover 470 is configured such that the shape of an internal space formed (defined) by the upper-part structure 471, the side-part structure 473, and the lower-part structure 475 substantially coincides with the shape of the outer surface of the first protective cover 420. Thereby, the second protective cover 470 is disposed such that, when it is mounted on the first protective cover 420 from the outer side of the first protective cover 420, the second protective cover 470 fits the outer surface of the first protective cover 420. When the second protective cover 470 is mounted on the first protective cover 420, the rubber material that makes up the second protective cover 470 itself expands, and therefore the second protective cover 470 may be designed with a size such that it strongly and tightly adheres to (grips) the outer surface of the first protective cover 420 so that the second protective cover 470 does not easily come off of the first protective cover 420.

According to the present embodiment, the second protective cover 470 further comprises, on left- and right-end parts of the side-part structure 473, engaging parts 477, which engage with left- and right-end parts of the side-part structure 433 that constitutes the first protective cover 420, so that the second protective cover 470 does not easily come off of the first protective cover 420. The engaging parts 477 are curved such that they surround the left- and right-end parts of the side-part structure 433 from the outer side to the inner side. Owing to these curvatures, the engaging parts 477 prevent the second protective cover 470 from coming off of the first protective cover 420 until they are disengaged from the first protective cover 420. The engaging parts 477 are formed, integrally with the upper-part structure 471 and the side-part structure 473, of a rubber material, which serves as the elastic material.

According to the present embodiment, if the user is to perform grinding work using a grinding stone, then the user can perform the processing work using the lower surface of the tool accessory 40 with the first protective cover 420 mounted on the grinder 400 without the second protective cover 470 being mounted.

On the other hand, if the user is to perform cutting work using a cutting stone, then the second protective cover 470 can be mounted on the first protective cover 420 such that an insertion opening 480, into which the first protective cover 420 is inserted in the rubber second protective cover 470, deforms such that it spreads to the left and right, and thereby the engaging parts 477 engage with the side-part structure 433 of the first protective cover 420. Thus, the user can cover, using the second protective cover 470, the area below the tool accessory 40 not covered by the first protective cover 420. The user can perform cutting work while the tool accessory 40 is thus covered from below.

Accordingly, regardless of whether the user performs processing work using a grinding stone or using a cutting stone, the tool accessory 40 is suitably covered and the processing work can be performed with good work efficiency.

Fifth Embodiment

The grinder 500 according to a fifth embodiment is configured such that a first protective cover 520, which has a configuration partly similar to that of the first protective cover 120 of the first embodiment, is mounted on the cover-connection part 31 of the second gear housing 30 of the grinder 1 shown in FIG. 1 or of a similar grinder.

Furthermore, according to the present embodiment, a second protective cover 570, which is configured to be mounted on and dismounted from the first protective cover 520, is provided. That is, according to the present embodiment, the combination of the first protective cover 520 and the second protective cover 570 shown in FIG. 16 to FIG. 24 is provided as a protective-cover set 510.

According to the present embodiment, the area of the tool accessory 40 covered by the protective-cover set 510 is changed by mounting the second protective cover 570 on the first protective cover 520 in either a first or a second orientation.

An oblong through hole 535, which is provided for fixing the second protective cover 570 to the first protective cover 520 is provided in the first protective cover 520. That is, the first protective cover 520 comprises a cover main body 530, which extends in the circumferential direction of the spindle 24, and a circular-tubular part 550, which is provided for fixing the cover main body 530 to the second gear housing 30.

The cover main body 530 comprises: a semicircular upper-part structure 531 for covering the rearward semicircular portion of the upper part of the tool accessory 40; and a side-part structure 533, which extends downward from an outer-circumferential-end edge of the upper-part structure 531. The upper-part structure 531 and the side-part structure 533 are integrally formed of, for example, a metal material. The cover main body 530 has a through hole 535, which is provided for mounting a fixture 590, at a 90° position of the side-part structure 533, which extends over a range in the circumferential direction from 0° to 180°. The side-part structure 533 comprises, at its lower end, a curved part 534 that curves toward the inner side in the radial direction.

The circular-tubular part 550 is configured the same as the circular-tubular part 150 of the first embodiment and is provided on the upper-part structure 531. The first protective cover 520 is fixed to the cover-connection part 31 of the second gear housing 30 using the circular-tubular part 550.

The second protective cover 570 has an inner surface that runs along (is configured to overlie) the outer surface of the cover main body 530 of the first protective cover 520. Specifically, the second protective cover 570 comprises an upper-part structure 571, which has an inner-surface shape that corresponds to the outer surface of the upper-part structure 531 of the first protective cover 520, and a side-part structure 573, which extends downward from an outer-circumferential-end edge of the upper-part structure 571. The upper-part structure 571 and the side-part structure 573 are integrally formed of, for example, a metal material. The side-part structure 573 has an inner-surface shape that corresponds to the outer surface of the side-part structure 533 of the first protective cover 520. However, as can be understood from FIG. 19 and FIG. 20, the side-part structure 573 does not comprise the portion that corresponds to the curved part 534 of the first protective cover 520.

The second protective cover 570 has a through hole 575, which is provided for mounting the fixture 590, at the 90° position of the side-part structure 573, which extends in the circumferential direction over a range of 0° to 180°. Regardless of whether the second protective cover 570 is mounted on the first protective cover 520 upward facing (that is, in an upward facing orientation) or downward facing (that is, in a downward facing orientation), the through hole 575 is disposed such that it communicates (is aligned) with the through hole 535 of the first protective cover 520.

FIGS. 16-20 show an example in which the second protective cover 570 is mounted upward facing on the first protective cover 520. FIGS. 21-24 show an example in which the second protective cover 570 is mounted downward facing on the first protective cover 520.

As shown in FIG. 16 to FIG. 20, if the second protective cover 570 is to be mounted upward facing on the first protective cover 520, then the second protective cover 570 is mounted on the first protective cover 520 such that an outer surface of an upper part of the first protective cover 520 and the inner surface of the second protective cover 570 that faces the tool accessory 40 approach one another. Thereby, the second protective cover 570 is housed on the outer surface side of the upper part of the first protective cover 520.

Thus, when the second protective cover 570 is mounted upward facing on the first protective cover 520, the through hole 535 of the first protective cover 520 and the through hole 575 of the second protective cover 570 are aligned (communicate) with one another. The fixture 590 is inserted, by the user, into the through hole 535 and into the through hole 575, which are aligned (in communication), from the outer side of the second protective cover 570. When the user operates a tab 591, the fixture 590 is rotated by 90° around the axis line of the fixture 590. Thereby, the second protective cover 570 is fixed to the first protective cover 520 such that the second protective cover 570 does not come off of the first protective cover 520.

Figure 19:
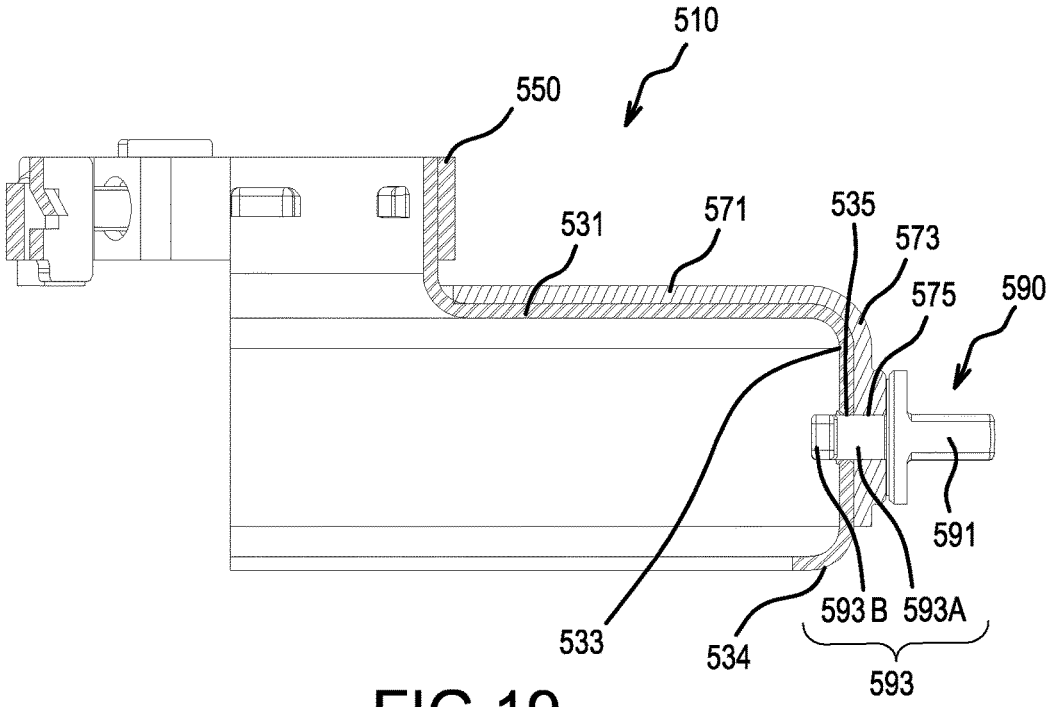
FIG. 19 is a cross-sectional view of the first protective cover, the second protective cover, and a fixture, according to the fifth embodiment, before the second protective cover is fixed, such that it is upward facing, to the first protective cover.
Figure 20:
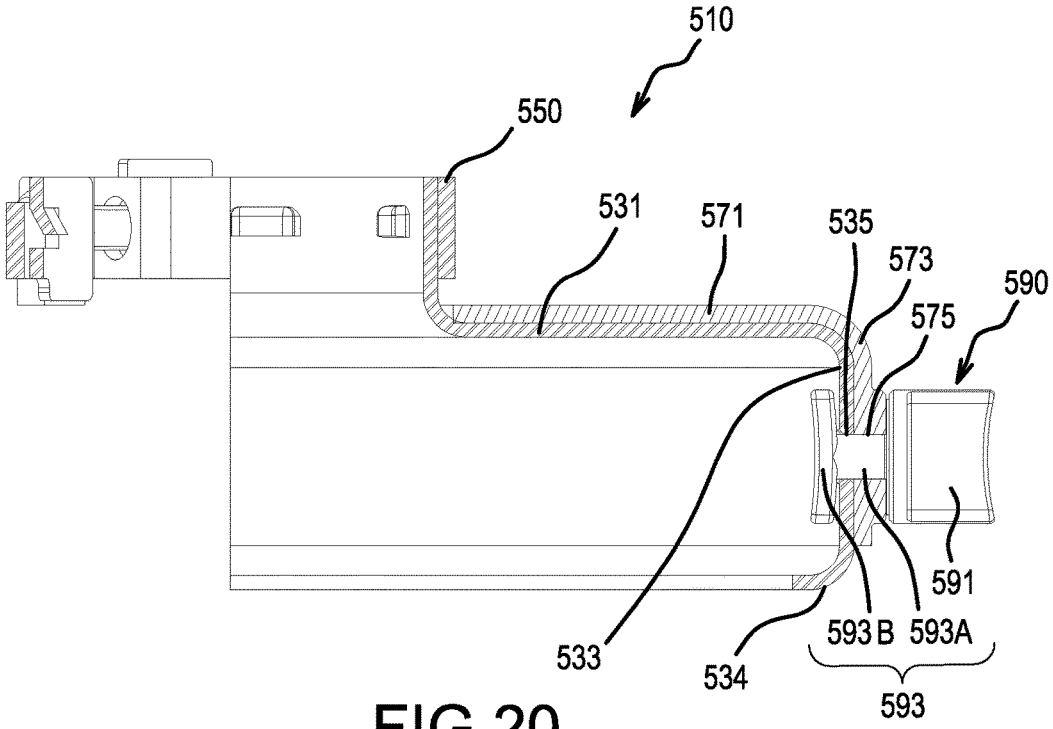
FIG. 20 is a cross-sectional view of the first protective cover, the second protective cover, and the fixture, according to the fifth embodiment, after the second protective cover is fixed, such that it is upward facing, to the first protective cover.
Figure 21:
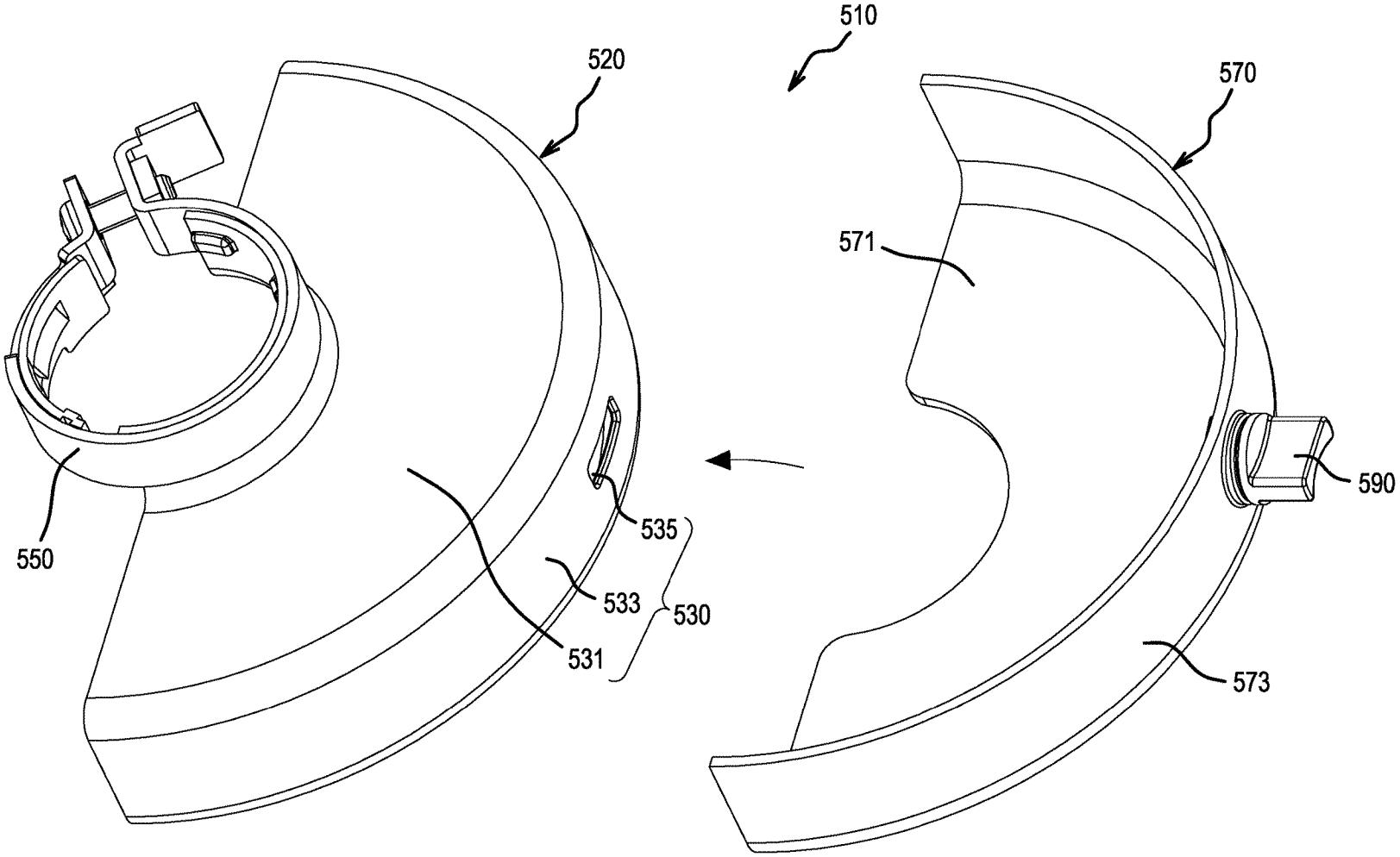
FIG. 21 is an oblique view of the first protective cover and the second protective cover, according to the fifth embodiment, before the second protective cover is mounted, such that it is downward facing, on the first protective cover.
Figure 22:
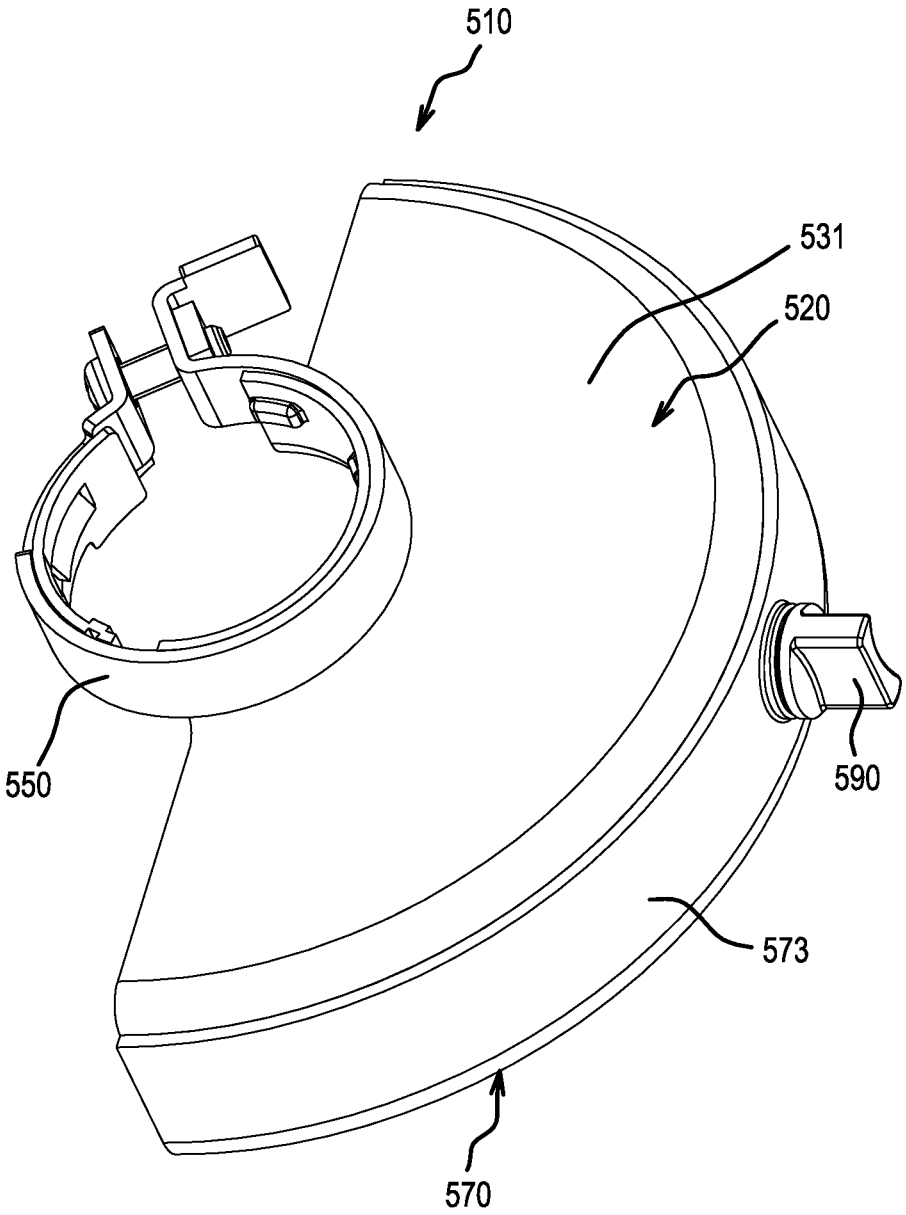
FIG. 22 is an oblique view of the first protective cover and the second protective cover, according to the fifth embodiment, after the second protective cover is mounted and fixed, such that it is downward facing, onto the first protective cover.
Figure 23:
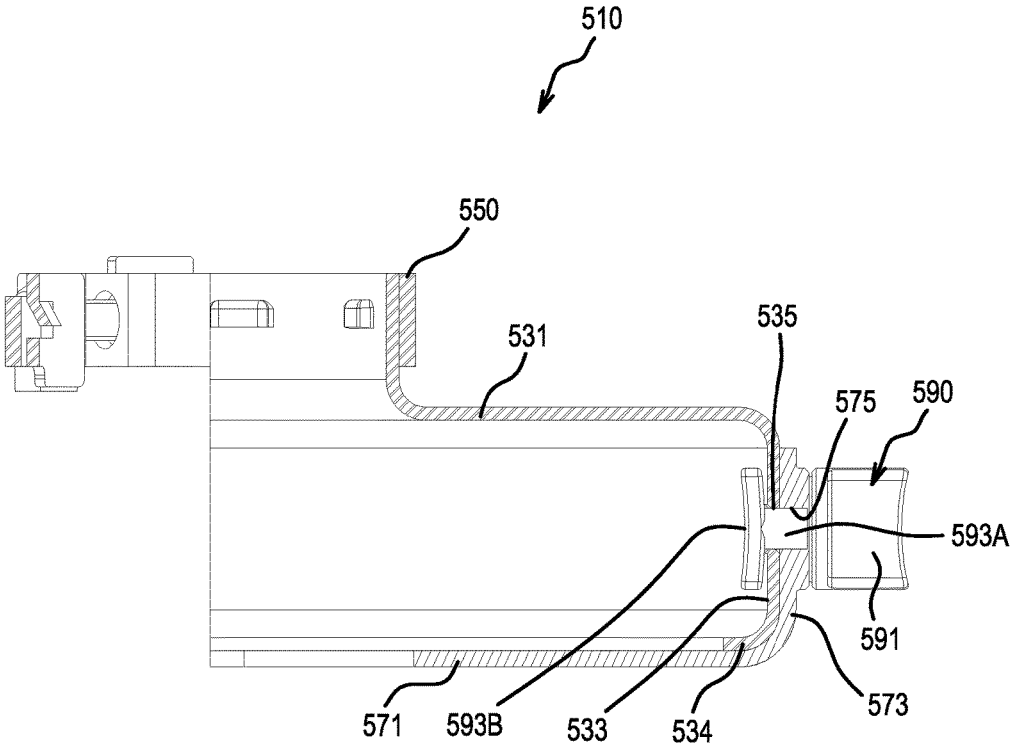
FIG. 23 is a cross-sectional view of the first protective cover, the second protective cover, and the fixture, according to the fifth embodiment, after the second protective cover is fixed, such that it is downward facing, to the first protective cover.
Figure 24:
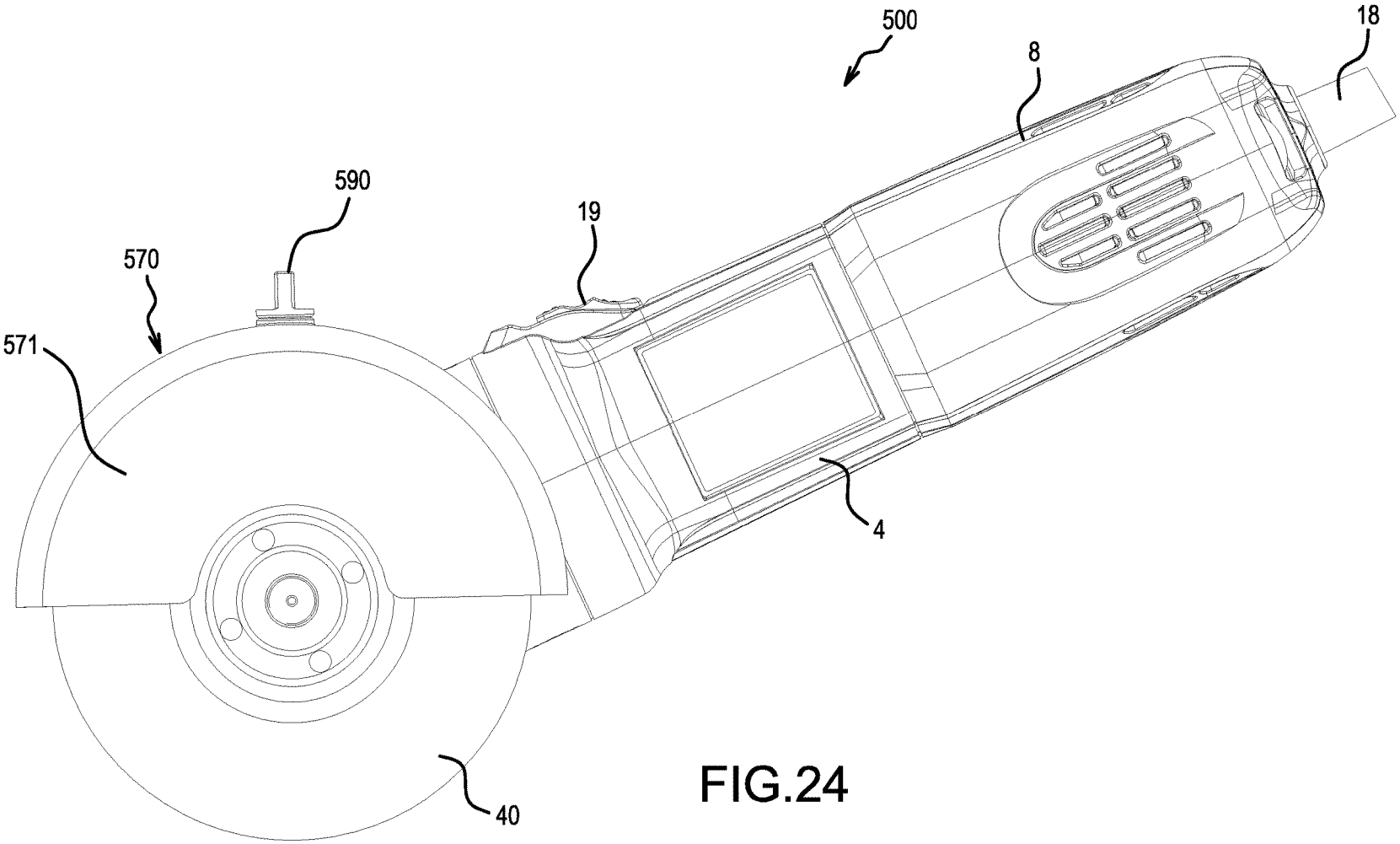
FIG. 24 is an oblique view that shows a second aspect of the grinder according to the fifth embodiment.

As shown in FIG. 19 and FIG. 20, the fixture 590 comprises the tab 591 and a key part 593, which protrudes from the tab 591 along the direction in which the fixture 590 is inserted into the through holes 535, 575. The key part 593 comprises a neck part 593A, which extends from the tab 591 in the insertion direction, and an oblong engaging part 593B, which is provided on the tip of the neck part 593A in the insertion direction.

The neck part 593A is configured to be inserted into the through holes 535, 575 and is formed in the shape of a rod having a diameter size that does not interfere with the through holes 535, 575 regardless of rotation of the tab 591 around the axis line of the fixture 590, which corresponds to the insertion direction. The neck part 593A is designed such that the amount by which the neck part 593A protrudes from the tab 591 corresponds to the thickness of the side-part structures 533, 573.

The section of the engaging part 593B that is perpendicular to the axis line of the fixture 590 is slightly smaller than, and has a shape similar to that of, the through holes 535, 575. According to the fixture 590 configured in this manner, the user can fix the second protective cover 570 so that it does not come off of the first protective cover 520 by inserting the engaging part 593B through the through holes 535, 575, as shown in FIG. 19, until it comes out on the inner side of the first protective cover 520, and then by turning the tab 591 to set the engaging part 593B so that it is tilted by 90° with respect to the oblong shape of the through holes 535, 575, as shown in FIG. 20.

As shown in FIG. 21 to FIG. 24, when the second protective cover 570 is to be mounted downward facing on the first protective cover 520, the inner surface of the second protective cover 570 opposes the inner surface of the first protective cover 520 and a space is formed that houses the tool accessory 40 between the inner surface of the second protective cover 570 and the inner surface of the first protective cover 520. Thereby, the second protective cover 570 is disposed such that it is capable of covering the area below the tool accessory 40 not covered by the first protective cover 520.

Likewise, when the second protective cover 570 is mounted downward facing on the first protective cover 520, the through hole 535 of the first protective cover 520 and the through hole 575 of the second protective cover 570 are aligned (communicate) with one another. The fixture 590 is inserted, by the user, from the outer side of the second protective cover 570 into the through hole 535 and into the through hole 575, which are aligned (communicate) with one another, and then the tab 591 is turned. Thereby, the second protective cover 570 is fixed to the first protective cover 520 such that the second protective cover 570 does not come off of the first protective cover 520.

According to the present embodiment, the area of the tool accessory 40 covered by the protective-cover set 510 can be modified by modifying the orientation of the second protective cover 570. For example, when the user is to perform a grinding process using a grinding stone, the user mounts the second protective cover 570 upward facing on the first protective cover 520 and thereby can perform the processing work. When the user is to perform a cutting process using a cutting stone, the user mounts the second protective cover 570 downward facing on the first protective cover 520 and thereby can perform the processing work while the area below the tool accessory 40 is covered.

Accordingly, a highly convenient grinder 500 can be provided according to the present embodiment. In particular, according to the present embodiment, when the second protective cover 570 is not being used for the purpose of covering the area below the tool accessory 40, the orientation of the second protective cover 570 can be changed to be the same, or substantially the same, orientation as that of the first protective cover 520. Accordingly, the possibility that the user will lose the second protective cover 570 can be reduced because the second protective cover 570 remains attached to the first protective cover 520 even when the second protective cover 570 is not being used to cover the area below the tool accessory 40.

Sixth Embodiment

The grinder 600 according to a sixth embodiment is configured such that a first protective cover 620, which has a configuration that is partly similar to that of the first protective cover 120 of the first embodiment, is mounted on the cover-connection part 31 of the second gear housing 30 of the grinder 1 shown in FIG. 1 or of a similar grinder.

Figure 25:
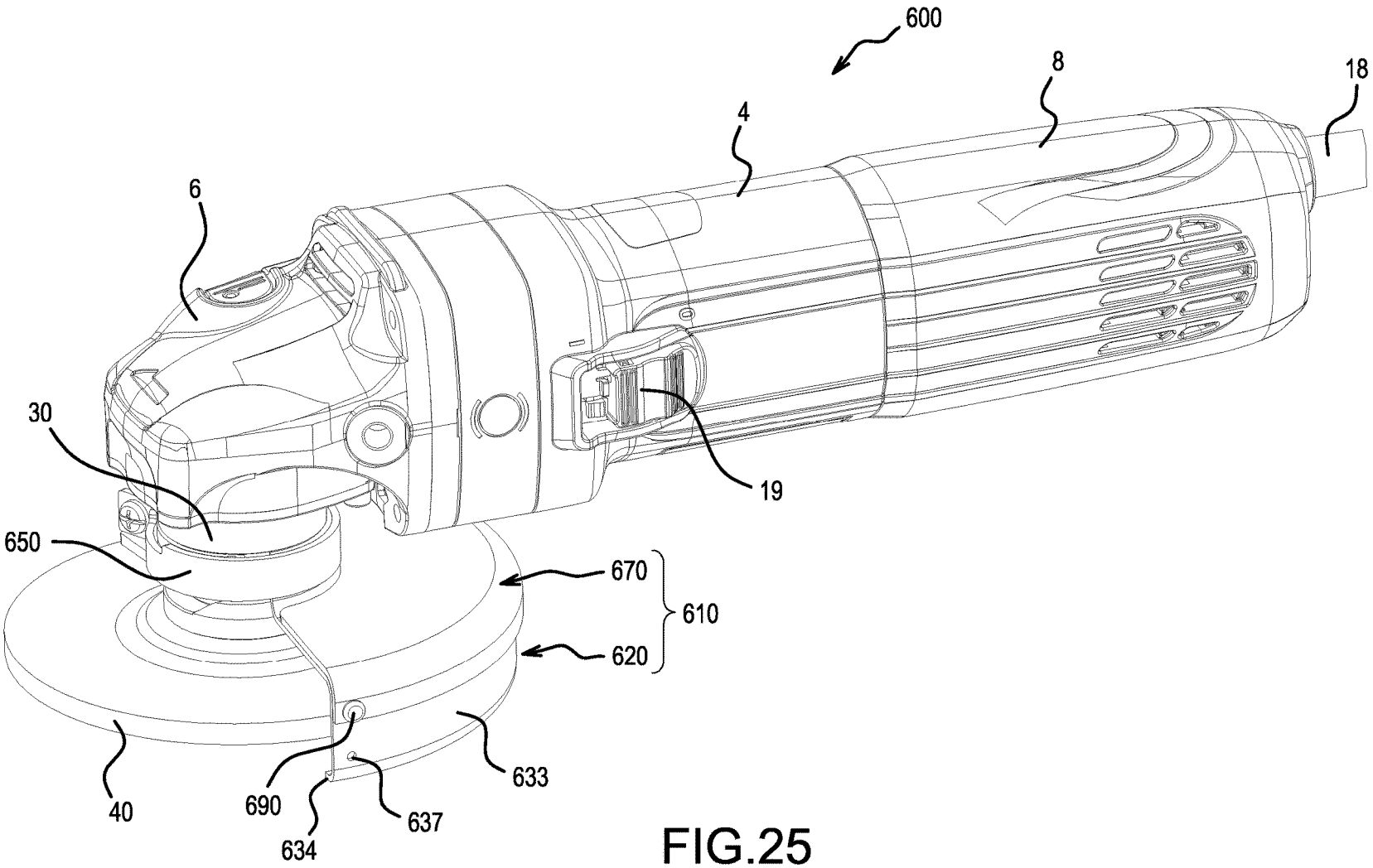
FIG. 25 is an oblique view that shows a first aspect of a grinder according to a sixth embodiment, the grinder including a first protective cover and a second protective cover.
Figure 26:
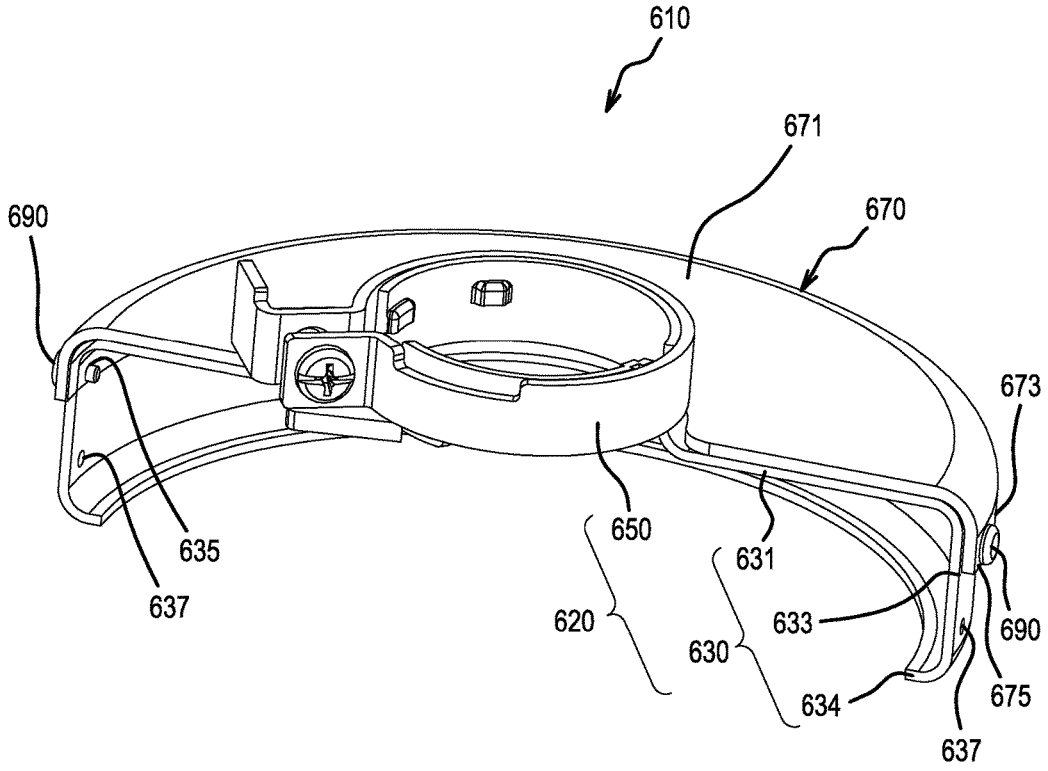
FIG. 26 is an oblique view of the first protective cover and the second protective cover, according to the sixth embodiment, wherein the second protective cover is fixed, such that it is upward facing, to the first protective cover.
Figure 27:
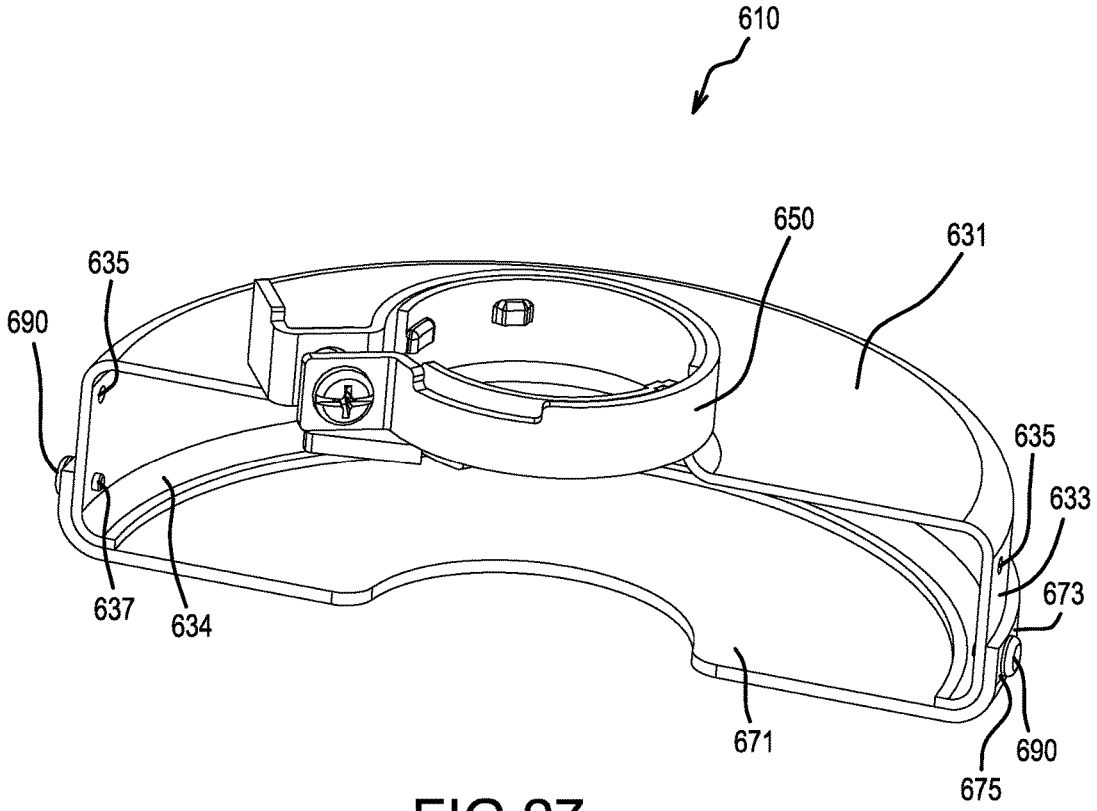
FIG. 27 is an oblique view of the first protective cover and the second protective cover, according to the sixth embodiment, wherein the second protective cover is fixed, such that it is downward facing, to the first protective cover.

Furthermore, according to the present embodiment, a second protective cover 670, which is configured to be mounted on and dismounted from the first protective cover 620, is provided. That is, according to the present embodiment, the combination of the first protective cover 620 and the second protective cover 670 shown in FIG. 25 to FIG. 27 is provided as a protective-cover set 610.

According to the present embodiment, the area of the tool accessory 40 covered by the protective-cover set 610 is changed by mounting the second protective cover 670 on the first protective cover 620 in either a first or a second orientation.

The first protective cover 620 is provided with screw holes 635, 637 for fixing the second protective cover 670 to the first protective cover 620. That is, the first protective cover 620 comprises a cover main body 630 and a circular-tubular part 650, wherein the cover main body 630 comprises a semicircular upper-part structure 631 and a side-part structure 633, which extends downward from an outer-circumferential-end edge of the upper-part structure 631. The side-part structure 633 comprises, at its lower end, a curved part 634 that curves toward the inner side in the radial direction. The first protective cover 620 is fixed to the cover-connection part 31 of the second gear housing 30 using the circular-tubular part 650. The cover main body 630 and the circular-tubular part 650 correspond to the cover main body 130 and the circular-tubular part 150 that constitute the first protective cover 120.

The cover main body 630 comprises, on both the left and right ends of the side-part structure 633, the screw holes 635 that communicate with through holes 675 of the second protective cover 670 when the second protective cover 670 is mounted upward facing, and the screw holes 637 that communicate with the through holes 675 of the second protective cover 670 when the second protective cover 670 is mounted downward facing.

The second protective cover 670 has an inner surface that follows along (overlies) the outer surface of the cover main body 630 of the first protective cover 620. Specifically, the second protective cover 670 comprises an upper-part structure 671 that has an inner-surface shape corresponding to the outer surface of the upper-part structure 631 of the first protective cover 620, and a side-part structure 673 that extends downward from an outer-circumferential-end edge of the upper-part structure 671. The upper-part structure 671 and the side-part structure 673 are integrally formed of, for example, a metal material. The side-part structure 673 has an inner-surface shape that corresponds to the outer surface of the side-part structure 633 of the first protective cover 620.

The second protective cover 670 further comprises, on both left and right ends of the side-part structure 673, the through holes 675 that are aligned (communicate) with the screw holes 635 of the first protective cover 620 when the second protective cover 670 is mounted upward facing on the first protective cover 620 and are aligned (communicate) with the screw holes 637 of the first protective cover 620 when the second protective cover 670 is mounted downward facing on the first protective cover 620. It should be understood that the through holes 675 exist at the locations of the side-part structure 673 at which screws 690 are mounted in FIG. 26 and FIG. 27.

As shown in FIG. 25 and FIG. 26, if the second protective cover 670 is to be mounted upward facing on the first protective cover 620, then the second protective cover 670 is mounted on the first protective cover 620 such that the outer surface of the upper part of the first protective cover 620 and the inner surface of the second protective cover 670 that faces the tool accessory 40 approach one another. Thereby, the second protective cover 670 is housed on the outer surface side of the upper part of the first protective cover 620.

Figure 28:
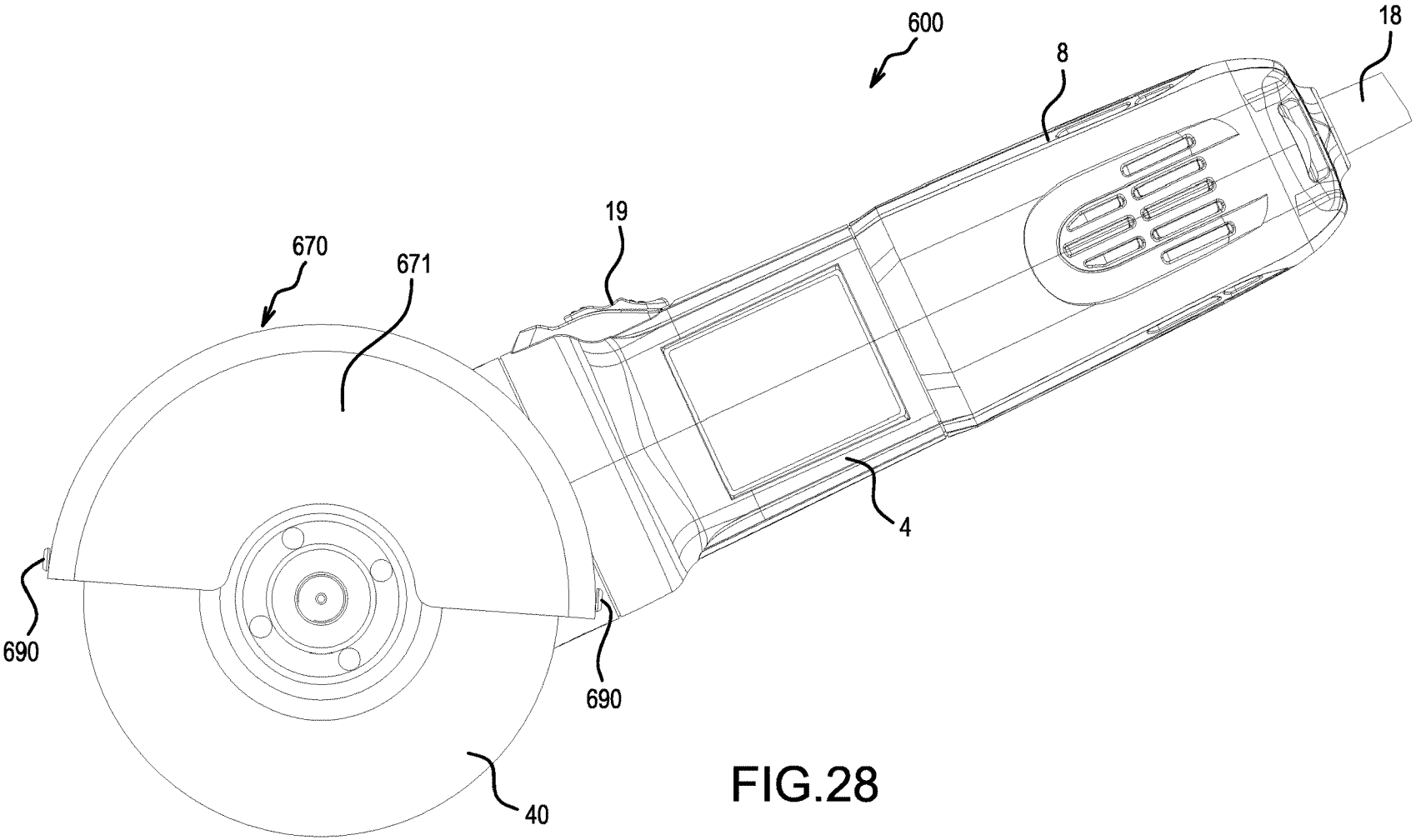
FIG. 28 is a bottom view that shows a second aspect of the grinder according to the sixth embodiment.
Figure 29:
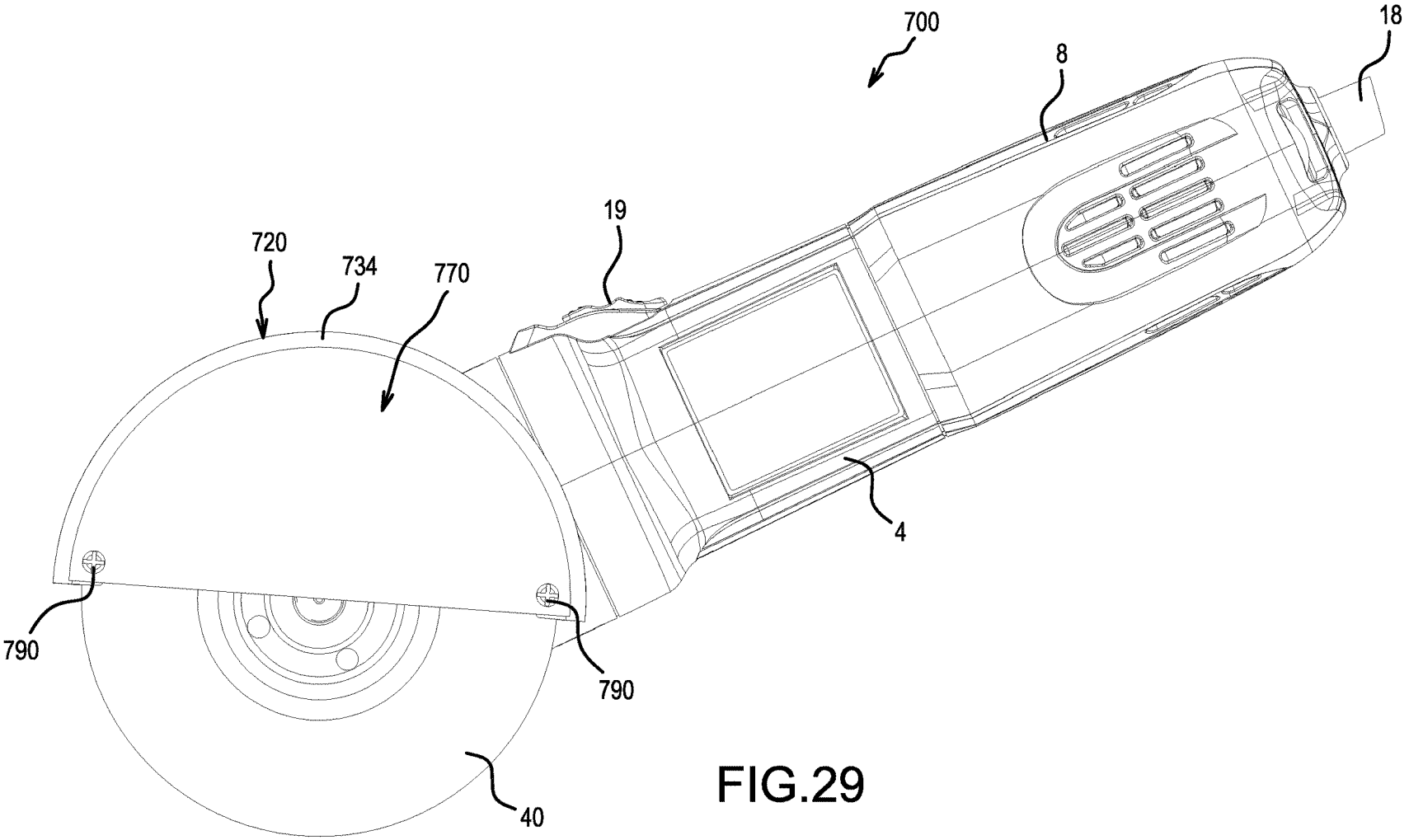
FIG. 29 is a bottom view of a grinder according to a seventh embodiment, the grinder including a first protective cover and a second protective cover.

On the other hand, as shown in FIG. 27 and FIG. 28, if the second protective cover 670 is to be mounted downward facing on the first protective cover 620, then the inner surface of the second protective cover 670 opposes the inner surface of the first protective cover 620 and thereby a space is formed that houses the tool accessory 40 between the inner surface of the second protective cover 670 and the inner surface of the first protective cover 620. Thereby, the second protective cover 670 is disposed such that the area below the tool accessory 40 not covered by the first protective cover 620 can be covered.

When the user is to perform a grinding process using a grinding stone, the user mounts the second protective cover 670 upward facing on the first protective cover 620 and thereby can perform the processing work. At this time, the user can screw-fasten the second protective cover 670 to the first protective cover 620 by screwing the screws 690 into the screw holes 635 of the first protective cover 620 through the through holes 675. When the second protective cover 670 is mounted upward facing on the first protective cover 620, the area below the tool accessory 40 is substantially uncovered, and therefore the user can perform the processing work with good efficiency using the lower surface of the tool accessory 40.

On the other hand, when the user is to perform a cutting process using a cutting stone, the user mounts the second protective cover 670 downward facing on the first protective cover 620 and thereby can perform the processing work while the area below the tool accessory 40 is covered. At this time, the user can screw-fasten the second protective cover 670 to the first protective cover 620 by screwing the screws 690 into the screw holes 637 of the first protective cover 620 through the through holes 675.

Thus, according to the present embodiment, by switching the orientation with which the second protective cover 670 is mounted on the first protective cover 620, the protective-cover set 610 can be switched between a mode suited to a grinding process and a mode suited to a cutting process, and therefore a highly convenient grinder 600 can be provided. Even when the second protective cover 670 is not used for the purpose of covering the area below the tool accessory 40, the advantage of being able to change the configuration of the protective cover set 610 and leave the second protective cover 670 mounted is the same as in the fifth embodiment.

Seventh Embodiment

The grinder 700 according to a seventh embodiment is configured such that a first protective cover 720, which has a configuration that is partly similar to that of the first protective cover 120 of the first embodiment, is mounted on the cover-connection part 31 of the second gear housing 30 of the grinder 1 shown in FIG. 1 or of a similar grinder.

Furthermore, according to the present embodiment, a second protective cover 770, which is configured to be mounted on and dismounted from the first protective cover 720, is provided. That is, according to the present embodiment, the combination of the first protective cover 720 and the second protective cover 770 shown in FIG. 29 to FIG. 33 is provided as a protective-cover set 710.

According to the present embodiment, the area of the tool accessory 40 covered by the protective-cover set 710 is changed by the second protective cover 770 being mounted on or dismounted from the first protective cover 720. The first protective cover 720 is provided with notches 735 (refer to FIG. 33) that engage with screws 790 for fixing the second protective cover 770 to the first protective cover 720.

Figure 30:
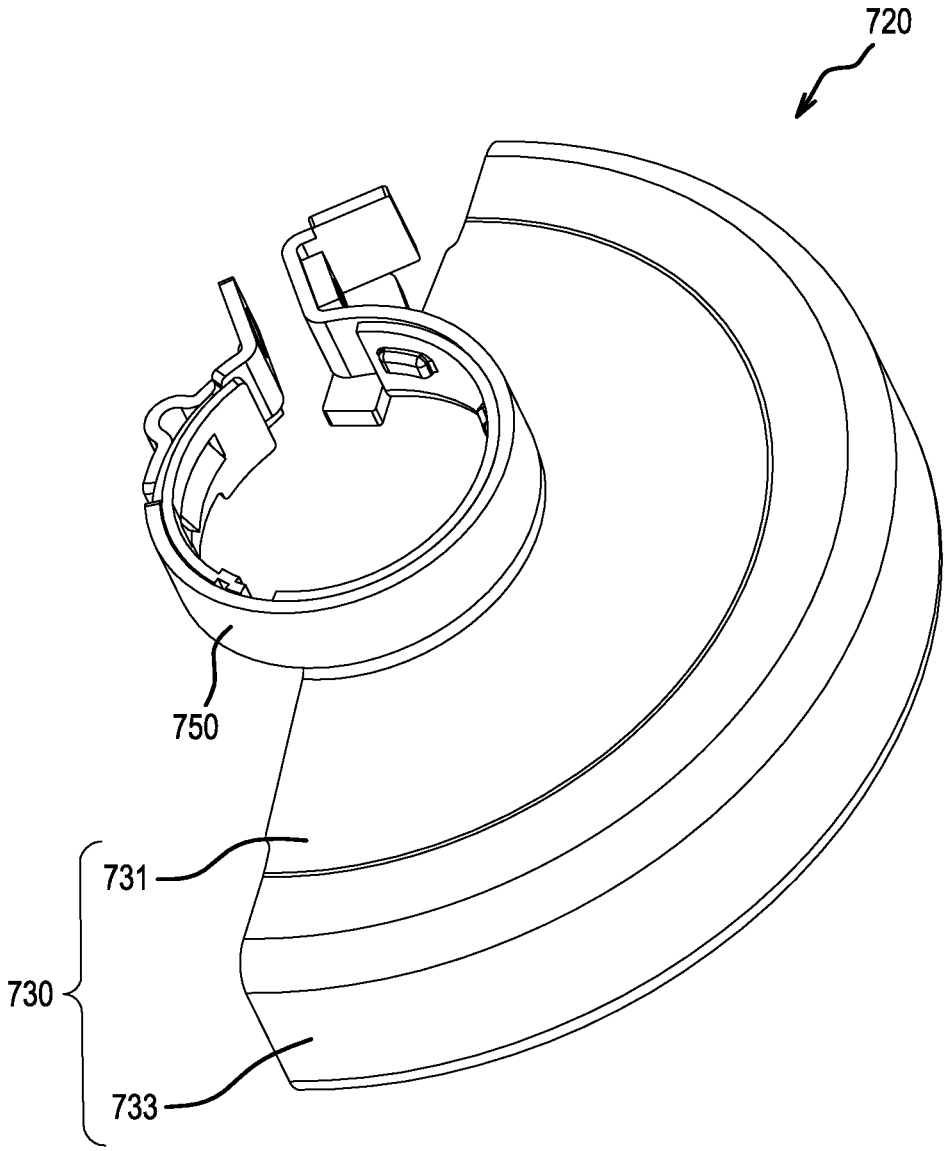
FIG. 30 is an oblique view of the first protective cover shown in FIG. 29.

That is, the first protective cover 720 comprises a cover main body 730 and a circular-tubular part 750, as shown in FIG. 30, wherein the cover main body 730 comprises a semicircular upper-part structure 731 and a side-part structure 733, which extends downward from an outer-circumferential-end edge of the upper-part structure 731.

The side-part structure 733 comprises, at its lower end, a curved part 734 that curves toward the inner side in the radial direction. In areas of the curved part 734 in the vicinity of the left and right ends of the side-part structure 733, the curved part 734 is provided with notches 735 that engage with the screws 790. The first protective cover 720 is fixed to the cover-connection part 31 of the second gear housing 30 using the circular-tubular part 750.

Figure 31:
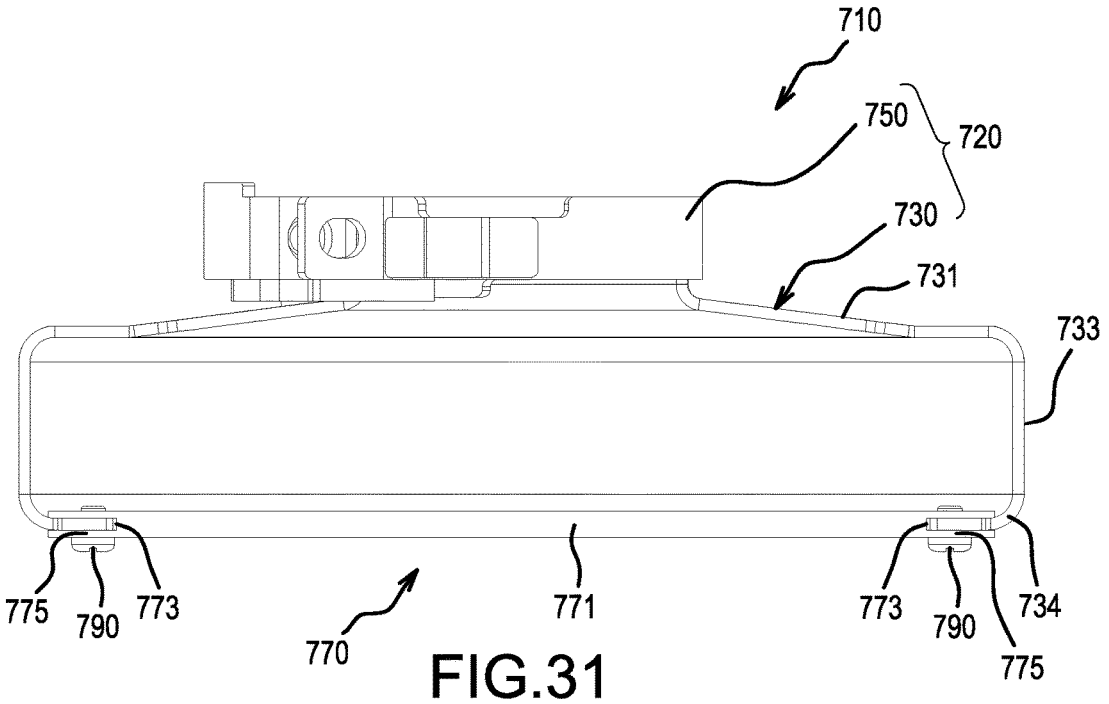
FIG. 31 is a side view of a first protective cover and a second protective cover for a grinder, according to the seventh embodiment, wherein the second protective cover is fixed to the first protective cover.
Figure 32:
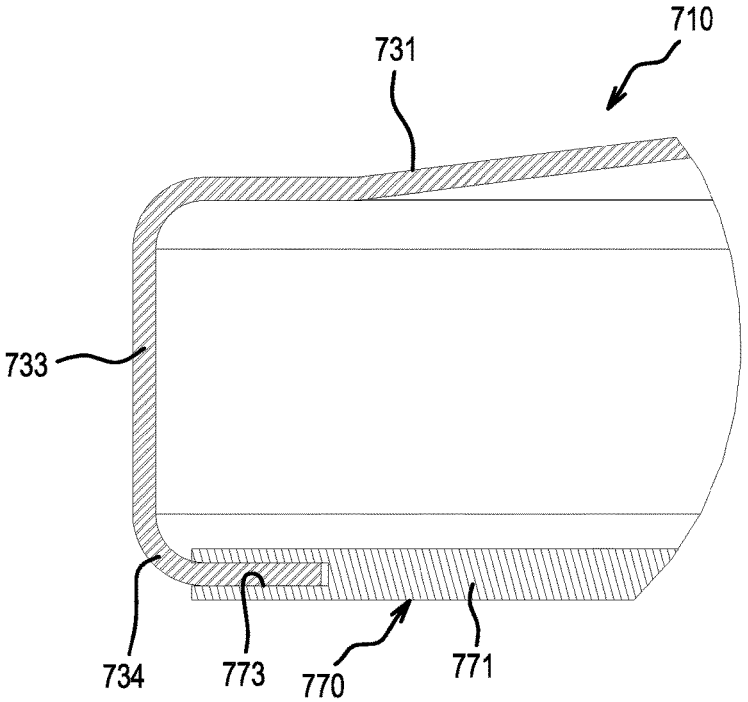
FIG. 32 is an enlarged cross-sectional view of the first protective cover and the second protective cover, according to the seventh embodiment, wherein the second protective cover is fixed to the first protective cover.

As shown in FIG. 31 and FIG. 32, the second protective cover 770 comprises a cover main body 771, which consists of a semicircular metal plate or a semicircular resin plate, and an elongated recess 773, which is provided in the circumferential direction on the side edge that constitutes the outer circumference of the cover main body 771. To ensure that the user's view is not obstructed, the cover main body 771 may be composed of a transparent resin plate or a mesh plate. The elongated recess 773 engages with the curved part 734 such that the curved part 734, which extends in the circumferential direction, is sandwiched below the first protective cover 720, and thereby the second protective cover 770 is held in an opening 739 of the first protective cover 720. The opening 739 mentioned here is an area on the lower side of the first protective cover 720 that is located on the inner side in the radial direction of a circle that follows from an end edge of the curved part 734, which extends in the circumferential direction, along that end edge.

Figure 33:
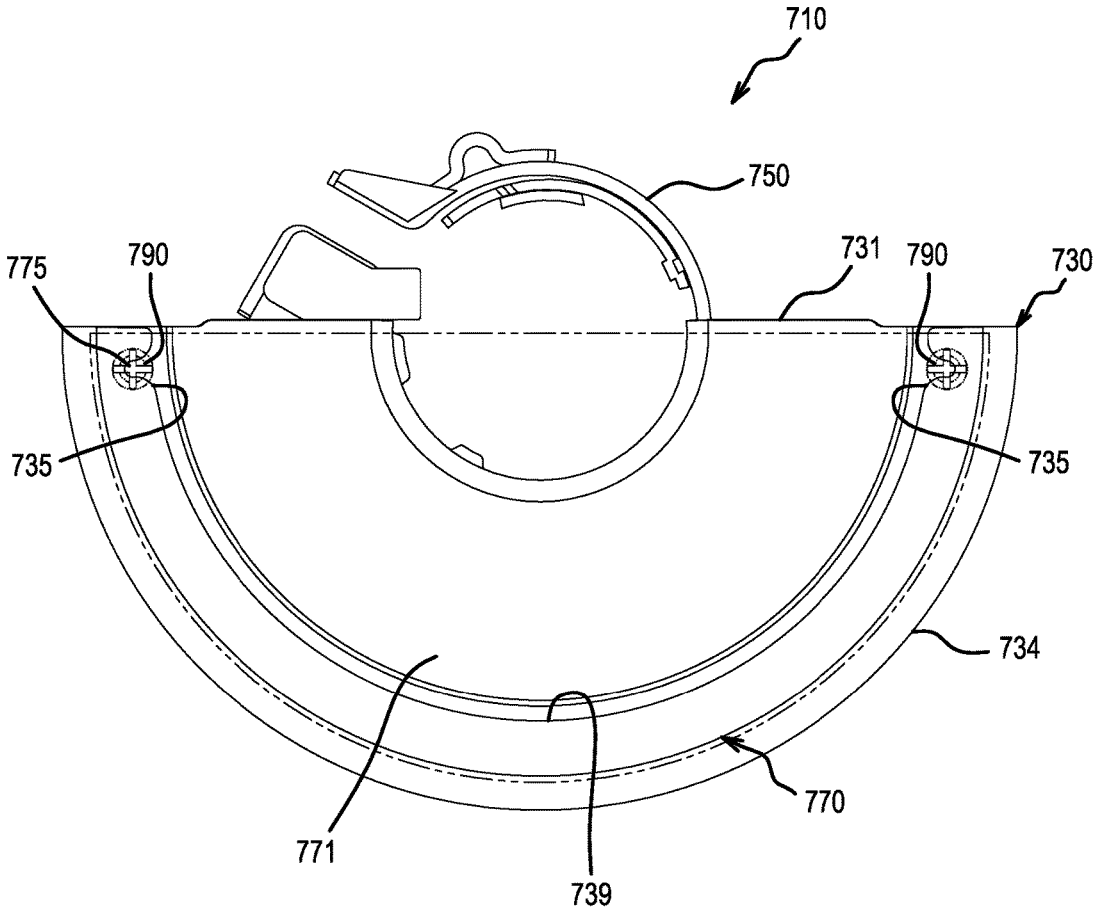
FIG. 33 is a partial, phantom bottom view of the first protective cover and the second protective cover, according to the seventh embodiment, wherein the second protective cover is fixed to the first protective cover.

The second protective cover 770 is inserted, from the side of the first protective cover 720, along the curved part 734 such that the curved part 734, which serves as a ridge that extends along the inner side of the opening 739, and the elongated recess 773 engage, and the second protective cover 770 is mounted such that it closes up the opening 739 of the first protective cover 720. At this time, the second protective cover 770 is held by the curved part 734, as shown in FIG. 33. In FIG. 33, the second protective cover 770 is shown in phantom view in order to show the aspect of the engagement of the curved part 734 and the elongated recess 773.

The cover main body 771 of the second protective cover 770 has through holes 775, which are aligned (communicate) with the notches 735 when the second protective cover 770 is mounted on the first protective cover 720. After the second protective cover 770 is mounted on the first protective cover 720, the screws 790 are installed (inserted) in the through holes 775 and the notches 735, and thereby the second protective cover 770 is screw-fastened to the first protective cover 720.

When the user is to perform a grinding process using a grinding stone, the processing work can be performed without mounting the second protective cover 770 on the first protective cover 720. In this state, the area below the tool accessory 40 is substantially uncovered, and therefore the user can perform the processing work with good efficiency using the lower surface of the tool accessory 40.

When the user is to perform a cutting process using a cutting stone, the user mounts the second protective cover 770 on the first protective cover 720 and thereby can perform processing work while the area below the tool accessory 40 not covered by the first protective cover 720 is covered. At this time, the second protective cover 770 can be simply fixed to the first protective cover 720 by the user screw-fastening the second protective cover 770 to the first protective cover 720 through the through holes 775 and the notches 735. Thus, according to the present embodiment, a grinder 700 that excels in work efficiency and dust-dispersion-reduction performance can be provided.

Eighth Embodiment

The grinder 800 according to an eighth embodiment is configured such that a first protective cover 820, which has a configuration that is partly similar to that of the first protective cover 120 of the first embodiment, is mounted on the cover-connection part 31 of the second gear housing 30 of the grinder 1 shown in FIG. 1 or of a similar grinder.

Furthermore, according to the present embodiment, a second protective cover 870, which is configured to be mounted on and dismounted from the first protective cover 820, is provided. That is, according to the present embodiment, the combination of the first protective cover 820 and the second protective cover 870 shown in FIG. 34 to FIG. 37 is provided as a protective-cover set 810.

According to the present embodiment, the area of the tool accessory 40 covered by the protective-cover set 810 is changed by the second protective cover 870 being mounted on and dismounted from the first protective cover 820. The first protective cover 820 is provided with a support body 840, which is designed to support the second protective cover 870 on the first protective cover 820.

That is, the first protective cover 820 comprises a cover main body 830, a support body 840, and a circular-tubular part 850, wherein the cover main body 830 comprises a semicircular upper-part structure 831 and a side-part structure 833, which extends downward from an outer-circumferential-end edge of the upper-part structure 831.

The side-part structure 833 comprises, on its lower end, a curved part 834 that curves toward the inner side in the radial direction. The support body 840 comprises a side-part structure 841, which has an inner surface that follows along (overlies) the outer circumference of the side-part structure 833, and an elongate-recess structure 843, which extends from a lower end of the side-part structure 841 toward the inner side in the radial direction. The side-part structure 841 and the elongate-recess structure 843 are integrally formed of, for example, a metal material.

Figure 35:
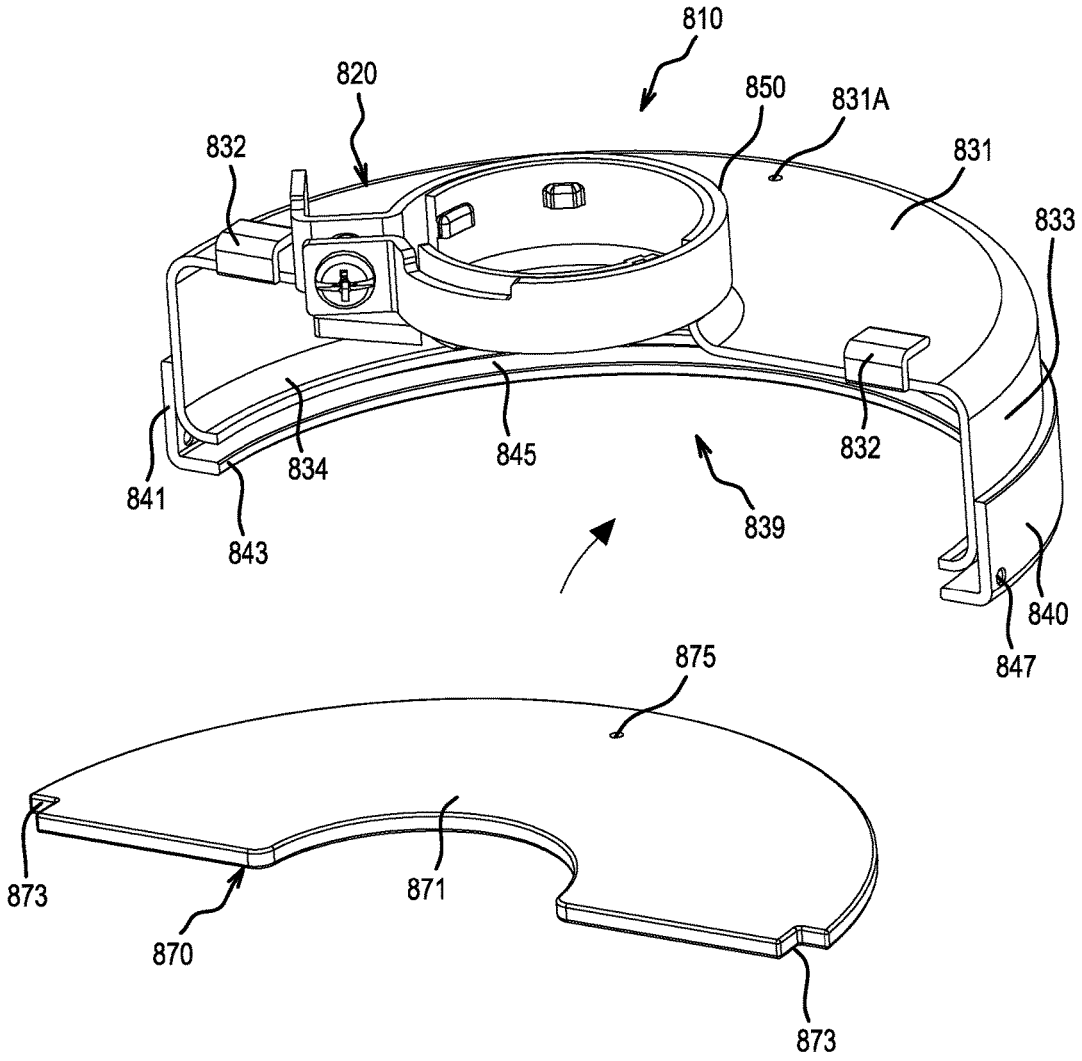
FIG. 35 is an oblique view of the first protective cover and the second protective cover for a grinder, according to the eighth embodiment, before the second protective cover is mounted on the first protective cover.

The side-part structure 841 is joined to the side-part structure 833 at the outer circumference of the side-part structure 833. For example, the side-part structure 841 is welded to the side-part structure 833. The elongate-recess structure 843 is disposed slightly below the curved part 834 and has an elongated recess 845, in the circumferential direction, that extends, along an inner side of an opening 839, between a lower surface of the curved part 834 and an upper surface of the elongate-recess structure 843. As shown in FIG. 35, the opening 839 has, on the lower side of the first protective cover 820, an area that is located on the inner side in the radial direction of a circle that follows from an end edge of the curved part 834, which extends in the circumferential direction, and along that end edge.

The side edge of the second protective cover 870 is inserted, from a transverse direction perpendicular to the up-down direction, into the elongated recess 845. Screw holes 847, into which screws 890 for fixing the second protective cover 870 to the first protective cover 820 are screwed, are provided on the left and right ends of the side-part structure 841.

In the second protective cover 870, engaging parts 873, which engage with the screws 890, are provided in the cover main body 871, which is a semicircular metal plate or a semicircular resin plate. In the cover main body 871, the engaging parts 873 are configured as notches for housing tip parts of the screws 890 that protrude from the screw holes 847 toward the inner side of the side-part structure 841.

Figure 36:
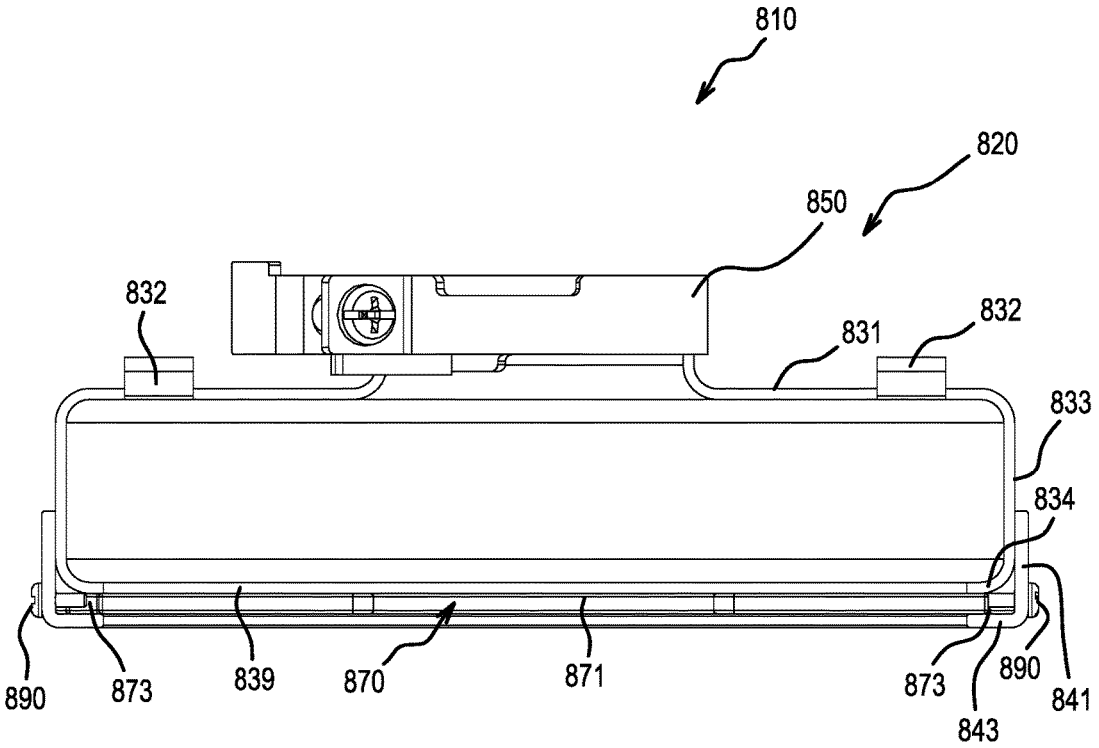
FIG. 36 is a side view of the first protective cover and the second protective cover, according to the eighth embodiment, after the second protective cover has been fixed to the first protective cover.
Figure 37:
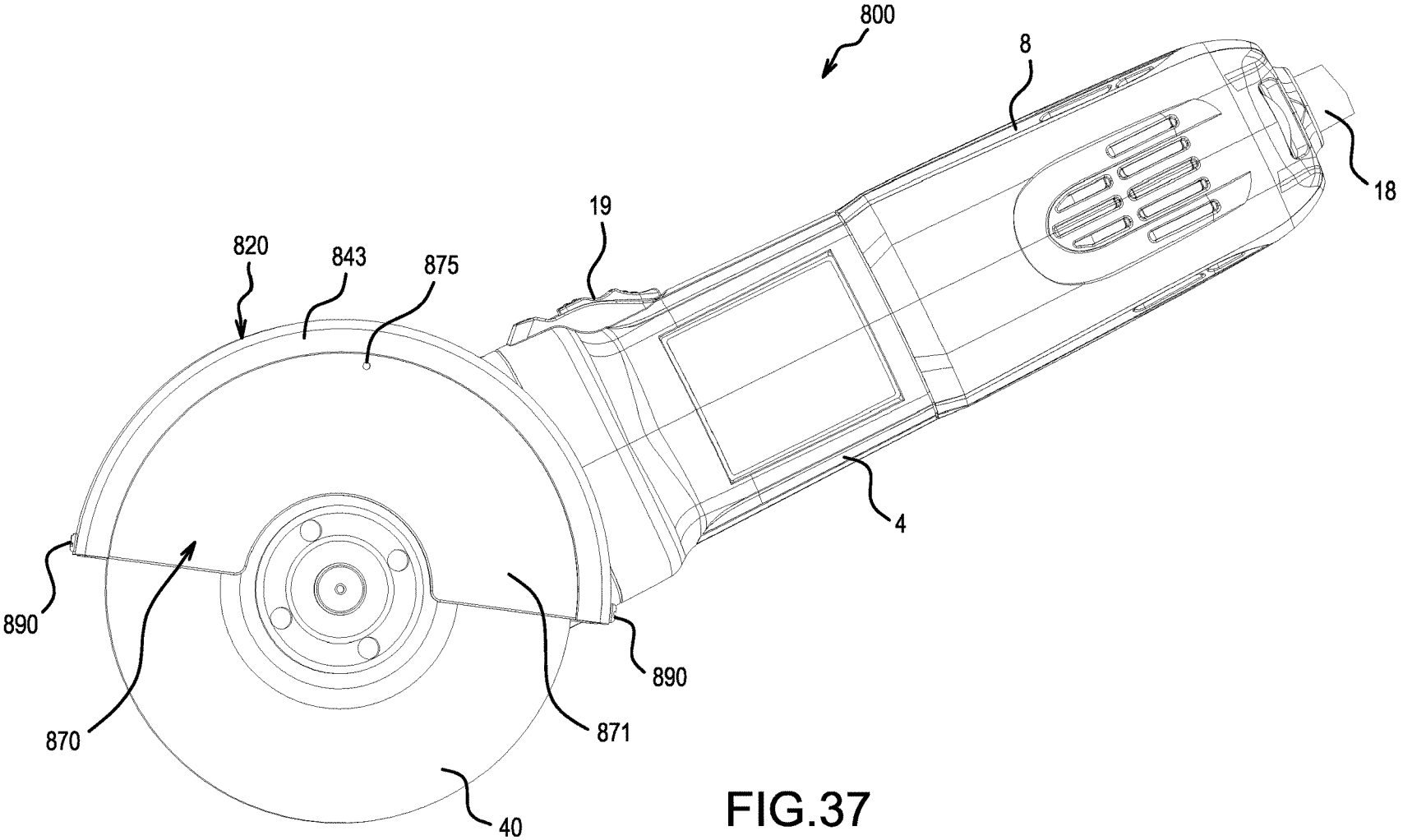
FIG. 37 is a bottom view that shows a second aspect of the grinder according to the eighth embodiment.

The second protective cover 870 is inserted, from the side of the first protective cover 820, into the space (the elongated recess 845) between the curved part 834 and the elongate-recess structure 843 such that the side edge of the cover main body 871 is housed therein, and thereby the second protective cover 870 is mounted so as to close up the opening 839 of the first protective cover 820. At this time, as shown in FIG. 36, the second protective cover 870 is supported by the elongate-recess structure 843.

When the second protective cover 870 is mounted on the first protective cover 820, the user can screw the screws 890 into the screw holes 847 such that the screws 890 protrude from the inner side of the side-part structure 841. Owing to this protrusion, the tips of the screws 890 hold the second protective cover 870 onto the first protective cover 820 such that the second protective cover 870 does not come out of the elongated recess 845 of the first protective cover 820.

According to the present embodiment, when the user is to perform a grinding process using a grinding stone, the user can perform the processing work without mounting the second protective cover 870 on the first protective cover 820. In this state, the area below the tool accessory 40 is substantially uncovered. On the other hand, when the user is to perform a cutting process using a cutting stone, the user mounts the second protective cover 870 on the first protective cover 820 and thereby can perform the processing work with the area below the tool accessory 40 that is not covered by the first protective cover 820 covered by the second protective cover 870. Accordingly, according to the present embodiment, it is possible to provide a grinder 800 that the user can operate with good efficiency in a satisfactory environment.

Figure 34:
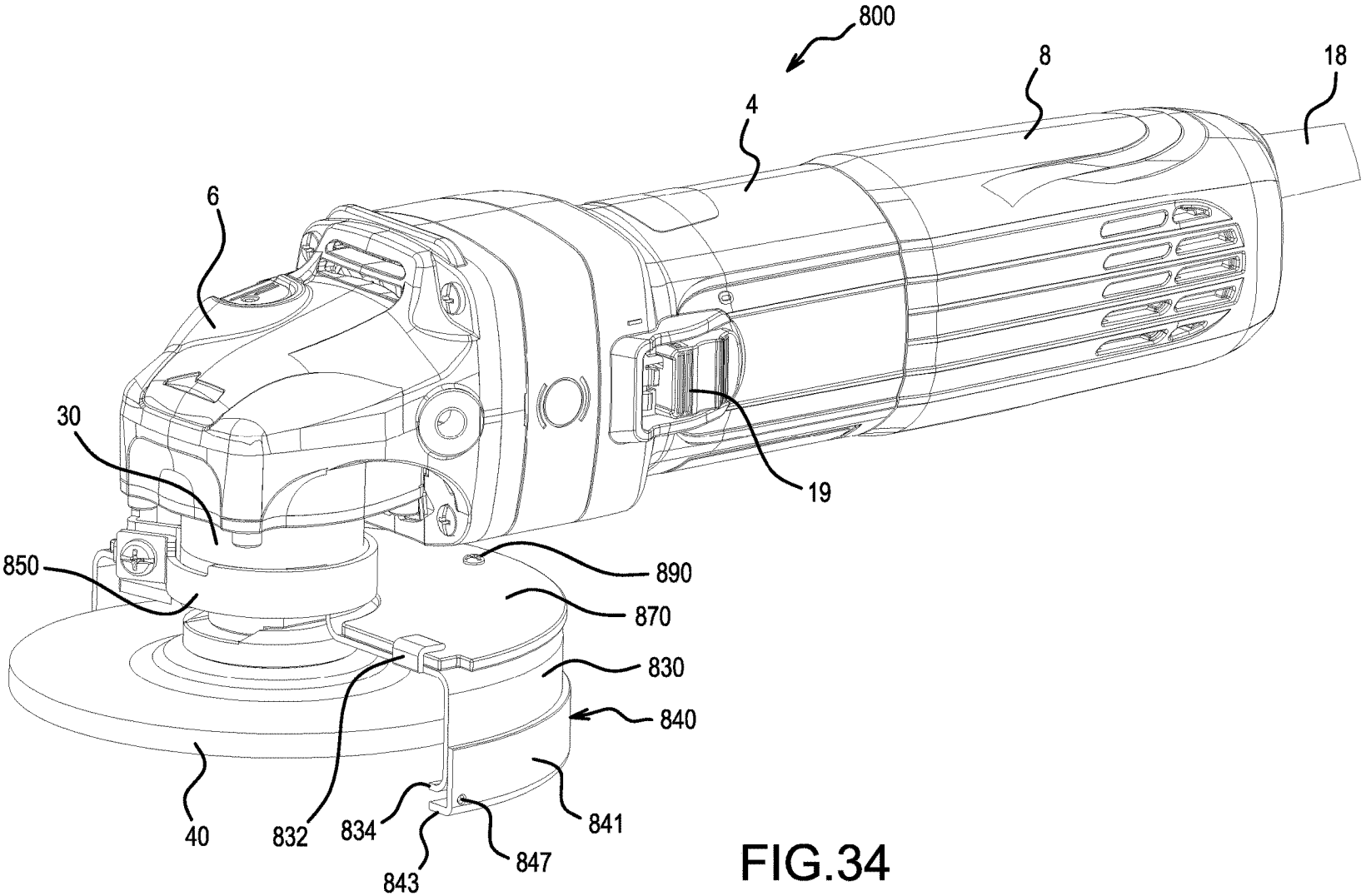
FIG. 34 is an oblique view that shows a first aspect of a grinder according to an eighth embodiment, the grinder including a first protective cover and a second protective cover.

According to the present embodiment, as shown in FIG. 34 and FIG. 35, housing parts 832, which are designed to house the second protective cover 870 when the user has not disposed the second protective cover 870 below the first protective cover 820, are provided on the upper-part structure 831. When the user is not using the second protective cover 870, the second protective cover 870 is fitted into the housing parts 832 and thereby can be fixed onto the first protective cover 820. The upper-part structure 831 has a screw hole 831A, which is aligned (communicates) with a through hole 875 of the second protective cover 870 when the second protective cover 870 is disposed on the first protective cover 820. The user can fix the second protective cover 870 onto the first protective cover 820 by screwing the screw 890 into the screw hole 831A through the through hole 875. Thus, a highly convenient grinder 800 can be provided according to the present embodiment.

Other Embodiments

The first embodiment to the eighth embodiment are explained above, but the grinder, the cover set, and the cover of the present invention are not limited to the above-mentioned embodiments, and various other embodiments can be adopted.

A function possessed by one structural element in the above-mentioned embodiments may be provided such that it is distributed among multiple (discrete) structural elements. A function possessed by multiple (discrete) structural elements may be integrated in one structural element. Some of the structural elements in the above-mentioned embodiments may be omitted. At least some of the structural elements in the above-mentioned embodiments may be added to or replaced by structural elements in other embodiments mentioned above. Any aspect that is included in the technical concepts specified based on the text of the claims is an embodiment of the present invention.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved grinders.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

Additional embodiments according to the present teachings include, but are not limited to:

A cover set is configured to at least partially cover a tool accessory, which is mounted on a spindle that protrudes downward from a housing of a grinder. The housing comprises an upper-part housing, which comprises a grip-fixing part for detachably affixing a grip configured to gripped by a user, and a lower-part housing, which is fixed to the upper-part housing and from which the spindle protrudes downward. The cover set comprises: a first cover configured to be provided in a circumferential direction of the spindle, and configured to be fixed to the lower-part housing, and to at least partially cover the tool accessory from above; and a second cover configured to be detachably fixable to the upper-part housing via the grip-fixing part and to at least partially cover an area of the tool accessory that is not covered by the first cover.

A cover set is provided for a grinder that comprises a housing, a spindle that protrudes downward from the housing, and a tool accessory mounted on the spindle. The cover set comprises: a cover configured to be fixed to the housing so as to circumferentially surround the spindle and at least partially cover the tool accessory from above, and an auxiliary cover that is at least partly composed of an elastic material, is detachably mounted on the cover by elastically deforming, and is configured such that it at least partially covers an area of the tool accessory not covered by the cover.

A cover is configured to at least partially cover a tool accessory, which is mounted on a spindle that protrudes downward from a housing of a grinder. The housing comprises a grip-fixing part configured to detachably affix a grip to be gripped (held) by a user. The cover comprises: a cover main body configured to at least partially cover the tool accessory from below; and a holder having a first end configured to be fixed to the housing via the grip-fixing part, that extends from the one end downward of the tool accessory and holds the cover main body below the tool accessory.

REFERENCE NUMBER LIST

1 Grinder
4 Motor housing
6 First gear housing
6A Grip-fixing part
8 Rear cover
12 Motor
14 Rotary shaft
20 First bevel gear
22 Second bevel gear
24 Spindle
25 Screw part
26 Bearing
28 Bearing
30 Second gear housing
31 Cover-connection part
32 Inner flange
34 Lock nut
40 Tool accessory
60 Protective cover
61 Upper-part structure
63 Side-part structure
64 Curved part
67 Circular-tubular part
70 Grip
71 Grip main body
73 Screw part
100 Grinder
110 Protective-cover set
120 First protective cover
130 Cover main body
131 Upper-part structure
133 Side-part structure
150 Lever-fixing part
155 Lever
170 Second protective cover
171 Cover main body
173 Connection part
175 Pivot pin
177 Extension part
180 Holder
181 Through hole
200 Grinder
210 Protective-cover set
270 Second protective cover
280 Holder
281 Through hole
300 Grinder
310 Protective-cover set
370 Second protective cover
380 Holder
381 Through hole
383 Connection part
385 Cover-main-body holding part
400 Grinder
410 Protective-cover set
420 First protective cover
430 Cover main body
431 Upper-part structure
433 Side-part structure
450 Circular-tubular part
455 Tightening part
470 Second protective cover
471 Upper-part structure
473 Side-part structure
475 Lower-part structure
477 Engaging part
480 Insertion opening
500 Grinder
510 Protective-cover set
520 First protective cover
530 Cover main body
531 Upper-part structure
533 Side-part structure
534 Curved part
535 Through hole
550 Circular-tubular part
570 Second protective cover
571 Upper-part structure
573 Side-part structure
575 Through hole
590 Fixture
591 Tab
593 Key part
593A Neck part
593B Engaging part
600 Grinder
610 Protective-cover set
620 First protective cover
630 Cover main body
631 Upper-part structure
633 Side-part structure
634 Curved part
635 Screw hole
637 Screw hole
650 Circular-tubular part
670 Second protective cover
671 Upper-part structure
673 Side-part structure
675 Through hole
690 Screw
700 Grinder
710 Protective-cover set
720 First protective cover
730 Cover main body
731 Upper-part structure
733 Side-part structure
734 Curved part
735 Notch
739 Opening
750 Circular-tubular part
770 Second protective cover
771 Cover main body
773 Elongated recess
775 Through hole
790 Screw
800 Grinder
810 Protective-cover set
820 First protective cover
830 Cover main body
831 Upper-part structure
831A Screw hole
832 Housing part
833 Side-part structure
834 Curved part
839 Opening

840 Support body
841 Side-part structure
843 Elongate-recess structure
845 Elongated recess
847 Screw hole
850 Circular-tubular part
870 Second protective cover
871 Cover main body
873 Engaging part
875 Through hole
890 Screw

The invention claimed is:

1. A grinder, comprising:
a motor;
a housing that houses the motor;
a spindle that protrudes downward from the housing, is configured to be driven by the motor, and thereby rotated;
a first cover that is provided in a circumferential direction of the spindle, is fixed to the housing, and is configured to at least partially cover a tool accessory, which is mounted on the spindle, from above; and
a second cover that is detachably mounted on the first cover,
wherein:
the first cover has a bottom opening that extends at least partially along a first arc of a circle,
the second cover, when mounted on the first cover in a first orientation, covers at least a segment of the bottom opening, the segment being defined by a second arc of the circle and a chord of the circle,
the second cover is configured such that when the tool accessory is mounted on the spindle, a front-most portion of the second cover is located rearward of a front-most portion of the tool accessory,
the second cover is mountable on the first cover in the first orientation and in a second orientation;
an area of the tool accessory covered by the first and second covers is greater when the second cover is mounted in the first orientation than when the second cover is mounted in the second orientation,
when the second cover is mounted on the first cover in the second orientation, an outer surface of an upper part of the first cover faces an inner surface of the second cover and the second cover is housed on the outer-surface side of the upper part of the first cover,
when the second cover is mounted on the first cover in the first orientation, the inner surface of the second cover faces the inner surface of the first cover and a space that houses the tool accessory between the inner surface of the second cover and the inner surface of the first cover is formed, and thereby the tool accessory is at least partially covered from below,
the first cover includes a substantially semicircular upper wall part having a connection part extending partially around an axis of the spindle for connecting the first cover to the housing,
the second cover includes a substantially semicircular upper wall part having a cutout, and
the cutout extends along the connection part when the second cover is mounted on the first cover in the second orientation.

2. The grinder according to claim 1, wherein the second cover is detachably mounted on the first cover and the second arc is about 180 degrees.

3. The grinder according to claim 1, wherein the second cover is substantially entirely composed of rubber and is mounted on and dismounted from the first cover attendant by elastically deforming.

4. The grinder according to claim 1, wherein:
the first and second covers have holes that are aligned with one another when the second cover is mounted on the first cover;
the grinder comprises a fixture configured to be mounted in and dismounted from the holes; and
the second cover is fixed to the first cover by mounting the fixture in the holes when the second cover is mounted on the first cover.

5. The grinder according to claim 1, wherein:
the first cover comprises a ridge that extends along an inner side of the opening;
a recessed part engages with the ridge of the first cover and is provided in a side edge of the second cover; and
the second cover is mounted on the first cover, such that the second cover engages with the ridge, is supported by the ridge, and at least partially covers the tool accessory from below at the opening.

6. The grinder according to claim 1, wherein:
the first cover has an elongated recess that extends along an inner side of the opening;
the second cover has a side edge that engages with the elongated recess of the first cover; and
the second cover is mounted on the first cover, such that it engages with the elongated recess, is supported by the elongated recess, and at least partially covers the tool accessory from below at the opening.

7. The grinder according to claim 1, wherein the second cover is fixed to the first cover by a screw.

8. The grinder according to claim 1, wherein:
the first cover includes a curved side wall extending from an arcuate edge of the upper wall part of the first cover, and
the second cover includes a curved side wall extending from an arcuate edge of the upper wall part of the second cover, and
the curved side wall of the second cover overlies the curved side wall of the first cover when the second cover is mounted on the first cover in the first orientation and in the second orientation.

9. A cover set configured to at least partially cover a spindle-mounted tool accessory of a grinder having a housing, the cover set comprising:
a first cover that is configured to be provided in a circumferential direction of the spindle, the first cover being configured to be fixed to the housing, and to at least partially cover the tool accessory from above; and
a second cover that is detachably mounted on the first cover;
wherein:
the first cover has a bottom opening that extends at least partially along a first arc of a circle,
the second cover, when mounted on the first cover in a first orientation, covers at least a segment of the bottom opening, the segment being defined by a second arc of the circle and a chord of the circle,
the second cover is configured such that when the cover set and the tool accessory are mounted on the grinder, a front-most portion of the second cover is located rearward of a front-most portion of the tool accessory,
the second cover is mountable on the first cover in the first orientation and in a second orientation;

an area of the tool accessory covered by the first and second covers is greater when the second cover is mounted in the first orientation than when the second cover is mounted in the second orientation, when the second cover is mounted on the first cover in the second orientation, an outer surface of an upper part of the first cover faces an inner surface of the second cover and the second cover is housed on the outer-surface side of the upper part of the first cover, when the second cover is mounted on the first cover in the first orientation, the inner surface of the second cover faces the inner surface of the first cover and a space that houses the tool accessory between the inner surface of the second cover and the inner surface of the first cover is formed, and thereby the tool accessory is at least partially covered from below, the first cover includes a substantially semicircular upper wall part having a connection part configured to extend partially around an axis of the spindle for connecting the first cover to the housing, the second cover includes a substantially semicircular upper wall part having a cutout, and the cutout extends along the connection part when the second cover is mounted on the first cover in the second orientation.

10. The cover set according to claim 9, wherein the second arc is about 180 degrees.

11. The cover set according to claim 9, wherein the second cover is configured to be fixed to the first cover by a screw or a fixture.

12. The cover set according to claim 9, wherein:

the first cover includes a curved side wall extending from an arcuate edge of the upper wall part of the first cover, and the second cover includes a curved side wall extending from an arcuate edge of the upper wall part of the second cover, and the curved side wall of the second cover overlies the curved side wall of the first cover when the second cover is mounted on the first cover in the first orientation and in the second orientation.

* * * * *